US006265822B1

(12) United States Patent
Kuroda et al.

(10) Patent No.: US 6,265,822 B1
(45) Date of Patent: Jul. 24, 2001

(54) ELECTRON BEAM APPARATUS, IMAGE FORMING APPARATUS USING THE SAME, COMPONENTS FOR ELECTRON BEAM APPARATUS, AND METHODS OF MANUFACTURING THESE APPARATUSES AND COMPONENTS

(75) Inventors: Kazuo Kuroda, Atsugi; Hiroshi Takagi, Yokohama; Noriaki Ohguri, Zama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/127,586

(22) Filed: Aug. 3, 1998

(30) Foreign Application Priority Data

| | | |
|---|---|---|
| Aug. 1, 1997 | (JP) | 9-207726 |
| Jun. 9, 1998 | (JP) | 10-160818 |
| Jul. 17, 1998 | (JP) | 10-203416 |
| Jul. 17, 1998 | (JP) | 10-203417 |
| Jul. 31, 1998 | (JP) | 10-217784 |

(51) Int. Cl.[7] ..... H01J 1/62

(52) U.S. Cl. ..... 313/495

(58) Field of Search ..... 313/495; 349/124, 349/123, 50, 51, 52

(56) References Cited

U.S. PATENT DOCUMENTS

| | | | | |
|---|---|---|---|---|
| 5,066,833 | | 11/1991 | Zalenski | 178/19 |
| 5,142,390 | * | 8/1992 | Ohta et al. | 349/52 |
| 6,008,872 | * | 12/1999 | den Boer et al. | 349/52 |
| 6,020,946 | * | 2/2000 | Callegari et al. | 349/124 |

FOREIGN PATENT DOCUMENTS

| | | |
|---|---|---|
| 57-118355 | 7/1982 | (JP) . |
| 2-257551 | 10/1990 | (JP) . |
| 3-49135 | 3/1991 | (JP) . |
| 3-55738 | 3/1991 | (JP) . |
| 4-28137 | 1/1992 | (JP) . |
| WO 94/18694 | 8/1994 | (WO) . |
| WO 96/02933 | 2/1996 | (WO) . |

OTHER PUBLICATIONS

Hartwell, M, et al., "Strong Electron Emission from Patterned Tin–Indium Oxide Thin Films, " IEEE Trans.ED Conf., (1975).

Mead, C.A., "Operation of Tunnel–Emission Devices", *Journ. of Appl. Physics*, vol. 32, No. 4, (1961).

Meyer, R., "Recent Development on "Microtips" Display at Leti, " *Tech. Digest of IVMC 91, Nagahama*, (1991).

Spindt, C.A., et al., Physical Properties of Thin–Film Field Emission Cathodes with Molybdenum Cones, *Journ. of Appl. Physics*, vol. 47, No. 12, (1976).

Sudarshan, T., et al., "The Effect of Chromium Oxide Coatings on Surface Flashover of Alumina Spacers in Vacuum, " *IEEE Trans. on Electrical Insulation*, vol. EI–11, No. 1 (1976).

Araki, H., et al., "Electroforming and Electron Emission of Carbon Thin Films, " *Vacuum*, vol. 26, No. 1 (1983).

Cross, J., et al., "The Effect of Cuprous Oxide Coatings on Surface Flashover of Dielectric Spacers in Vacuum, " *IEEE Trans. on Electrical Insulation* vol. EI–9, No. 4, (1974).

(List continued on next page.)

*Primary Examiner*—Vip Patel
*Assistant Examiner*—Todd Reed Hopper
(74) *Attorney, Agent, or Firm*—Fitzpatrick, Cella, Harper & Scinto

(57) ABSTRACT

An electron beam apparatus having a first substrate having an electron emitting portion, a second substrate facing the first substrate, and a component provided between the first and second substrates, wherein carbon nitride is formed at least on the surface of the component to suppress charges on the component or suppress a change in the charge amount to thereby suppress a beam orbit from being shifted from a desired orbit.

28 Claims, 15 Drawing Sheets

OTHER PUBLICATIONS

Dittmer, G., "Electrical Conduction and Electron Emission of Discontinuous Thin Films, " Thin Solid Films, vol. 9 (1972).

Elinson, M.I., et al., "The Emission of Hot Electrons and the Field Emission of Electrons from Tin Oxide, " *Radio Eng. Electronic Physics*, vol. 10, (1965).

* cited by examiner

SCHEMATIC VIEW OF SPUTTERING APPARATUS

ELECTRON BEAM APPARATUS, IMAGE FORMING APPARATUS USING THE SAME, COMPONENTS FOR ELECTRON BEAM APPARATUS, AND METHODS OF MANUFACTURING THESE APPARATUSES AND COMPONENTS

BACKGROUND OF THE INVENTION

1. Field of the Invention

The present invention relates to an electron beam apparatus using electron emission, an image forming apparatus using the electron beam apparatus, and a component for the electron beam apparatus, and also relates to methods of manufacturing these apparatuses and component.

2. Related Background Art

Two types of electron emitting elements are known, hot cathode elements and cold cathode elements. As the cold cathode element, a surface conductivity type electron emitting element, a field emission type element (hereinafter abbreviated as FE type), a metal/insulator/metal type electron emitting element (hereinafter abbreviated as MIM type) are known.

The surface conductivity type electron emitting element utilizes the phenomenon that as current flows through a thin film small area formed on a substrate in parallel to the film surface, electrons are emitted. Surface conductivity type electron emitting elements heretofore reported include an element using an $SiO_2$ thin film proposed by Elinson et aL (M. I. Elinson, Radio Eng. Electron: Phys., 10, 1290 (1965)), an element using an Au thin film (G. Dittmer: "Thin Solid Films", 9, 317 (1972), an element using an $In_2O_3$/$SnO_2$ thin film (M. Hartwell and C. G. Fonstad: "IEEE Trans. ED Conf", 519 (1975), and an element using a carbon thin film (Hisashi ARAKI et al, "Vacuum", Vol. 26, No. 1, 22 (1983).

As a typical example of the structure of a surface conductivity type electron emitting element, the element proposed by M. Hartwell et al is shown in the plan view of FIG. 12. In FIG. 12, reference numeral 1 represents a substrate, and reference numeral 2 represents a conductive thin film made of metal oxide formed through sputtering. The conductive thin film 2 is patterned to have an H-character shape as shown in FIG. 12. An electron emitting portion 3 is formed by subjecting the conductive thin film 2 to an energization process called an energization forming process.

The energization forming process forms the electron emitting portion by using an electric power. With this process, a constant d.c. voltage or a d.c. voltage very gradually raising its amplitude in the order of, for example, about 1 V/min is applied across opposite ends of the conductive thin film 2 to locally break, deform, or decompose the conductive thin film 2 to thereby form the electron emitting portion 3 having a high electrical resistance. Part of the conductive thin film 2 locally broken, deformed or decomposed has cracks so that as an appropriate voltage is applied to the conductive thin film 2, electron s are emitted near at the cracks.

Examples of FE type elements are disclosed, for example, in "Field Emission", Advance In Electron Physics, 8, 89 (1956) o r C. A. Spirndt, "Physical Properties of Thin-Film Field Emission Cathodes with molybdenum Cones", J. Appl. Phys. 47, 5248 (1976).

As a typical example of the structure of an FE type element, the element proposed by C. A. Spindt et al is shown in the cross sectional view of FIG. 13. In FIG. 13, reference numeral 4 represents a substrate, reference numeral 5 represents an emitter wiring layer made of conductive material, reference numeral 6 represents an emitter cone, reference numeral 7 represents an insulating layer, and reference numeral 8 represents a gate electrode. With this element, as an appropriate voltage is applied across the emitter cone 6 and gate electrode 8, electrons are emitted from the tip of the emitter cone 6 through field emission.

Another example of the FE type element has an emitter and a gate electrode disposed on a substrate generally in parallel to the substrate surface, without incorporating the lamination structure shown in FIG. 13.

An MIM type element is disclosed, for example, in C. A. Mead, "Operation of Tunnel-emission Devices", J. Appl. Phys., 32, 646 (1961). A typical example of the MIM type element is shown in the cross sectional view of FIG. 14. In FIG. 14, reference numeral 9 represents a substrate, reference numeral 10 represents a lower electrode made of metal, reference numeral 11 represents a thin insulating film having a thickness of about 80 to 300 angstroms, and reference numeral 12 represents an upper electrode made of metal having a thickness of about 80 to 300 angstroms. With the MIM type element, as an appropriate voltage is applied across the upper and lower electrodes 12 and 10, and electrons are emitted from the surface of the upper electrode 12.

As compared to the hot cathode elements, the cold cathode elements described above can emit electrons at a low temperature and do not require a heater. Therefore, the cold cathode element has the structure simpler than the hot cathode element, a fine element can be manufactured, and even if a number of elements are disposed on a substrate at a high density, a problem of thermal melting of the substrate and the like does not occur. As different from a hot cathode element operating with a heated heater and therefore with a slow response speed, the cold cathode element has an advantage of a fast response speed. The application field of the cold cathode element includes an image forming apparatus such as an image displaying apparatus and an image recording apparatus, an electron beam source, and the like.

As an example of the application of a cold cathode element to an image displaying apparatus, image displaying apparatuses proposed by the present assignee and disclosed in U. S. Pat. No. 5,066,883 and Japanese Patent Laid-Open Application Nos. 2-257551 and 4-28137 are known. These image displaying apparatuses use a combination of surface conductivity type electron emitting elements and a fluorescent film which generates light upon impingement of an electron beam. As an example of the application to an image displaying apparatus using a number of FE type elements, a flat plane type display apparatus reported by R. Meyer et al is known (R. Meyer, "Recent Development on Micro-tips Display at LETI", Tech. Digest of 4th Int. Vacuum Microelectronics Conf., Nagahama, pp. 6 to 9 (1991)). An example of the application to an image displaying apparatus using a number of MIM type elements, is disclosed in Japanese Patent Laid-Open Application No. 3-55738 filed by the present assignee.

The surface conductive type electron emitting element in particular has a simple structure and is easy to manufacture. It has therefore an advantage that a number of elements can be easily formed in a large area. As compared to a liquid crystal display, an image displaying apparatus using a combination of surface conductivity type electron emitting elements and a fluorescent film does not require a back light because of its self-light-emission type and is excellent in a broad angle of view.

In a flat plane type image displaying apparatus, a number of electron emitting elements are disposed on a flat substrate, and a fluorescent member generating light upon impingement of electrons is disposed facing the flat substrate. The electron emitting elements are disposed on the substrate in a two-dimensional shape (the elements are called a multi-electron-beam source). Each element is connected to row and column direction wiring lines. One method of driving elements is a simple matrix drive method. In order to emit electrons from an element on a desired row of the matrix, a select voltage is applied to the row and synchronously with this, a signal voltage is applied to the column wiring line. Electrons emitted from the electron emitting element at the selected row are accelerated toward the fluorescent member and excite it to generate light therefrom. By sequentially applying the select voltage to each row, an image can be displayed.

It is necessary to maintain a vacuum in the space between a substrate (rear plate) on which electron emitting elements are formed in the two-dimensional matrix shape and the substrate (face plate) on which a fluorescent member and an acceleration electrode are formed. Since an atmospheric pressure is applied to the rear and face plates, the substrate having a thickness resistant to the atmospheric pressure become necessary, the more the displaying apparatus becomes large. However, the thick substrate increases the weight of the displaying apparatus. In view of this, support members (spacers) are inserted between the rear and face plates to maintain the distance between the rear and face plates and prevent breakage of the rear and face plates.

The spacer is required to have a mechanical strength sufficient for being resistant to the atmospheric pressure, and also required not to greatly affect the orbit of electrons flying between the rear and face plates. The reason of influencing the electron orbit is charged on the spacer. Charges on the space may be ascribed to that part of electrons emitted from the electron source or electrons reflected from the face plate become incident upon the spacer and secondary electrons are emitted from the spacer or ions generated by collision are attached to the spacer surface.

As the spacer is charged positive, electrons flying near the spacer are attracted to the spacer so that a displayed image near the spacer has a distortion. The influence of charges becomes conspicuous as the distance between the rear and face plates becomes large.

Generally, charges are suppressed by imparting a conductivity to the charge surface to flow some current therethrough. This concept was introduced into the spacer and the space surface was coated with tin oxide, which is disclosed in Japanese Patent Laid-Open Application No. 57-118355. A method of coating the spacer with PbO containing glass is disclosed in Japanese Patent Laid-Open Application No. 3-49135.

In improving a creeping discharge breakdown voltage, it is effective if the spacer surface is coated with material having a small secondary emission ratio. As an example of a material having a small secondary emission ratio coated on the spacer surface, chromium oxide (T. S. Sudarshan and J. D. Cross: IEEE Trans. EI-11, 32 (1976) and copper oxide (J. D. Cross and T. S. Sudarshan: IEEE Trans. EI-9, 146 (1974) are known.

SUMMARY OF THE INVENTION

It is an object of the present invention to provide an electron beam apparatus comprises a first substrate having an electron emitting portion, a second substrate facing the first substrate, and a first component provided between the first and second substrates, in which the influence of an electron beam by the first component is changed to a more proper state, a change of the influence is properly suppressed, or discharge on the first member is suppressed.

An electron beam apparatus of this invention comprises: a first substrate having an electron emitting portion; a second substrate facing the first substrate; and a first component provided between the first and second substrates, wherein carbon nitride is formed on the surface of the first component.

An image forming apparatus of this invention comprises: a first substrate having an electron emitting portion; a second substrate facing the first substrate; and having an image forming component for forming an image in accordance with electrons emitted from the electron emitting portion; and a first component provided between the first and second substrates, wherein carbon nitride is formed on the surface of the first component.

The image forming component may be a fluorescent film.

In a component for an electron beam apparatus of this invention, the electron beam apparatus comprises: a first substrate having an electron emitting portion; a second substrate facing the first substrate; and a first component provided between the first and second substrates as the component for the electron beam apparatus, wherein carbon nitride is formed on a surface of the first component.

In the electron beam apparatus, image forming apparatus, and component for the electron beam apparatus, the following structure may be introduced.

For example, the first component may be a spacer for maintaining a distance between the first and second substrates. Since the spacer is disposed often near at an electron orbit, the invention can be applied effectively.

The carbon nitride may be formed on the first component in the form of a film.

The carbon nitride of this invention may be electrically insulative or conductive. The term "insulative" used herein is intended to mean that the carbon nitride has a large resistance value sufficient for neglecting a change in a charge amount of the first component, and the term "conductive" used herein is intended to mean the carbon nitride has a resistance value in the order capable of relaxing charges on the first component.

The carbon nitride may contain metal elements for adjusting a specific resistivity of the carbon nitride.

The carbon nitride may be formed on a conductive base material. The conductive base material may be a material having a conductivity, or may have a film formed on the material surface to provide a conductivity by itself or together with the base material.

When the carbon nitride is formed on the conductive base material an d if the conductive base material contains some sub stance such as sodium which affects the film containing carbon nitride, an other film may be inserted between the base material and the film containing at least carbon nitride, the inserted film suppressing precipitation of the substance such as sodium or suppressing replacement of the composition of the film containing at least carbon nitride by the substance such as sodium.

The first component may be connected to electrodes having different potentials. Charges on the first component can be relaxed by a potential difference between the electrodes. If the resistance of the carbon nitride is large and charges on the carbon nitride are difficult to be removed directly therefrom , the charges may be removed via the base material, via a film between the carbon nitride film and base material, or via both the base material and the film. Of the electrodes at different potentials, one may be on the first substrate and the other may be on the second substrate. The electrode on the first substrate may be a wiring line to the electron emitting portion of the first substrate. The electrode on the second substrate may be an electrode applied with a potential for accelerating electrons emitted from the electron emitting portion.

The first substrate may include a plurality of electron emitting portions. The electron emitting portions may be disposed in a matrix shape. As the wiring line of the first substrate connected to the first component, part of a matrix wiring layer connected to the electron emitting element disposed in the matrix shape may be used.

The electron emitting portion may be an electron emitting portion of a surface conductivity type electron emitting element formed on the first substrate.

In a method of manufacturing an electron beam apparatus, an image forming apparatus, or a component for the electron beam apparatus, the carbon nitride on the first component may be formed by sputtering.

The methods of manufacturing an electron beam apparatus include the following methods of the invention.

A method of manufacturing an electron beam apparatus having a first substrate having an electron emitting portion, a second substrate facing the first substrate, and a first component provided between the first and second substrates, comprises the step of: forming carbon nitride on a surface of the first component by a sputtering process, the sputtering process being executed while a negative bias voltage is applied to a base material of the first component.

A method of manufacturing an electron beam apparatus having a first substrate having an electron emitting portion, a second substrate facing the first substrate, and a first component provided between the first and second substrates, comprises the step of: exposing carbon nitride formed on a surface of the first component to a gas containing at least halogen or halogen compound.

The methods of manufacturing an image forming apparatus include the following methods of the invention.

A method of manufacturing an image forming apparatus having a first substrate having an electron emitting portion, a second substrate facing the first substrate and having an image forming component for forming an image in accordance with electrons emitted from the electron emitting portion, and a first component provided between the first and second substrates, comprises the step of: forming carbon nitride on a surface of the first component by a sputtering process, the sputtering process being executed while a negative bias voltage is applied to a base material of the first component.

A method of manufacturing an image forming apparatus having a first substrate having an electron emitting portion, a second substrate facing the first substrate and having an image forming component for forming an image in accordance with electrons emitted from the electron emitting portion, and a first component provided between the first and second substrates, comprises the step of: exposing carbon nitride formed on a surface of the first component to a gas containing at least halogen or halogen compound.

The methods of manufacturing a component for an electron beam apparatus include the following methods of the invention.

A method of manufacturing a component for an electron beam apparatus having a first substrate having an electron emitting portion, a second substrate facing the first substrate, and a first component provided between the first and second substrates as the component for the electron beam apparatus, comprises the step of: forming carbon nitride on a surface of the first component by a sputtering process, the sputtering process being executed while a negative bias voltage is applied to a base material of the first component.

A method of manufacturing a component for an electron beam apparatus having a first substrate having an electron emitting portion, a second substrate facing the first substrate, and a first component provided between the first and second substrates as the component for the electron beam apparatus, comprises the step of: exposing carbon nitride formed on a surface of the first component to a gas containing at least halogen or halogen compound.

In the method including the step of exposing carbon nitride formed on a surface of the first component to a gas containing at least halogen or halogen compound, it is preferable to execute the exposing step at a temperature higher than a highest temperature used until the electron beam apparatus is completed. It is also preferable to execute the exposing step at a temperature higher than a temperature at which the first and second substrates are adhered and sealed.

In each of the methods of this invention, the carbon nitride on the surface of the first component may be formed by sputtering a carbon target in a nitrogen atmosphere or the carbon target may be graphite.

DETAILED DESCRIPTION OF THE PREFERRED EMBODIMENTS

Figure 2:
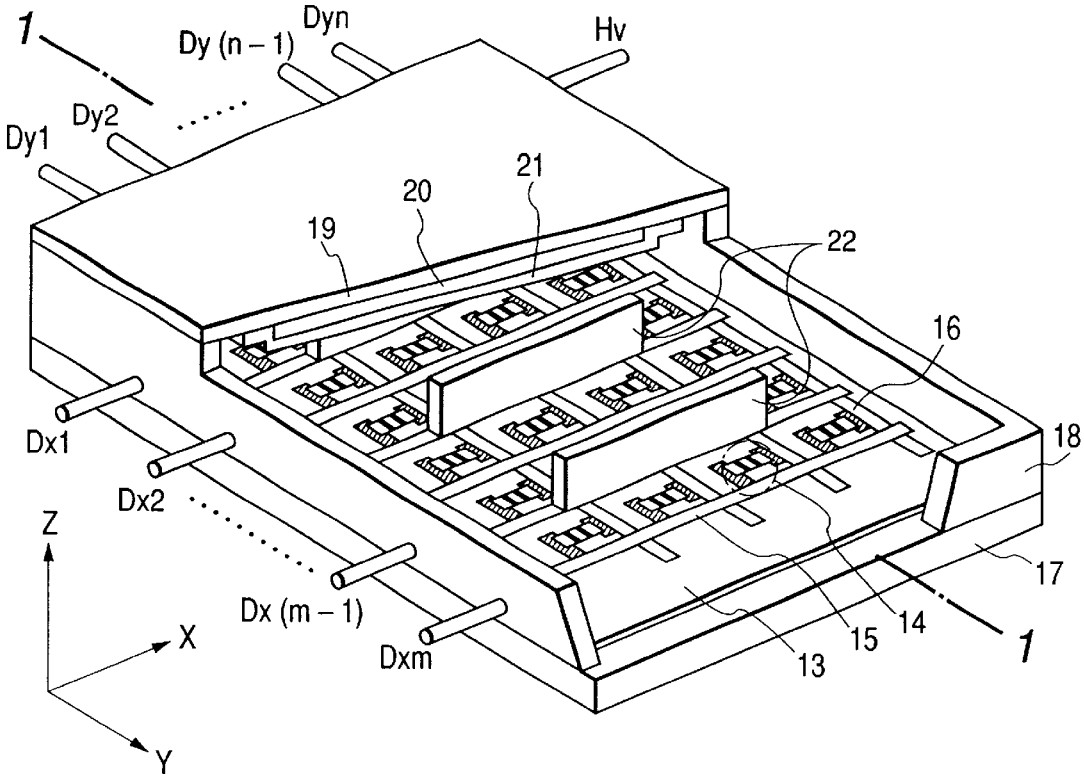
FIG. 2 is a perspective view partially in a broken state, of the display panel of this invention.

FIG. 2 is a perspective view of a display panel which is one application example of an image forming apparatus of this invention. The of the display panel is partially broken to show the internal structure thereof. The detailed description of the display panel will be later given.

In FIG. 2, reference numeral 17 represents a rear plate, reference numeral 18 represents a side wall, and reference numeral 19 represents a face plate, these components 17 to 19 constituting a hermetically sealed container which maintains the inside of the display panel in a vacuum state. In assembling the hermetically sealed container, these components are required to be adhered together at their junctions, in order provide sufficient strength and air tightness. For example, such a sealing was achieved by coating frit glass on the junctions and baking it in the atmospheric air or in a nitrogen atmosphere for 10 minutes or longer at 400 to 500° C. A method of evacuating the inside of the hermetically sealed container will be later described. Since the inside of the hermetically sealed container is maintained to be vacuum in the order of about $10^{-4}$ Pa, the hermetically sealed container is structured to be resistant to the atmospheric pressure in order to prevent the container from being broken by the atmospheric pressure or unexpected impact. To this end, spacers 22 are provided which correspond to the term "first component" used in the appended claims and specification.

Figure 1:
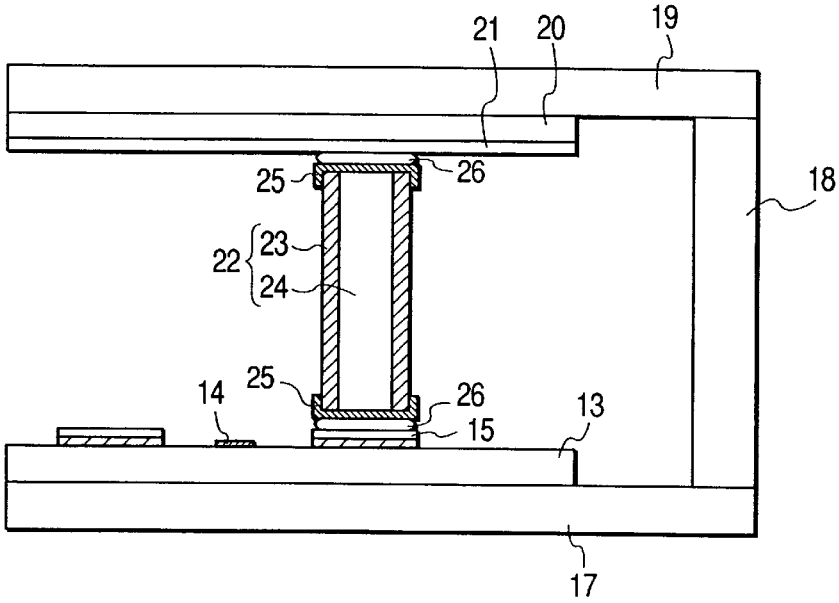
FIG. 1 is a schematic cross sectional view showing the structure of a spacer and its nearby components of a display panel of this invention.

FIG. 1 is a schematic cross sectional view of the display panel, showing mainly the peripheral components of the spacer 22. Reference numerals given in FIG. 1 correspond to the reference numerals given in FIG. 2. Reference numeral 14 represents a cold cathode electron source including an electron emitting portion. Reference numeral 17 represents the rear panel, reference numeral 18 represents the side wall, and reference numeral 19 represents the face plate, these components 17 to 19 constituting the hermetically sealed container which maintains the inside of the display panel in a vacuum state.

Figure 15A:
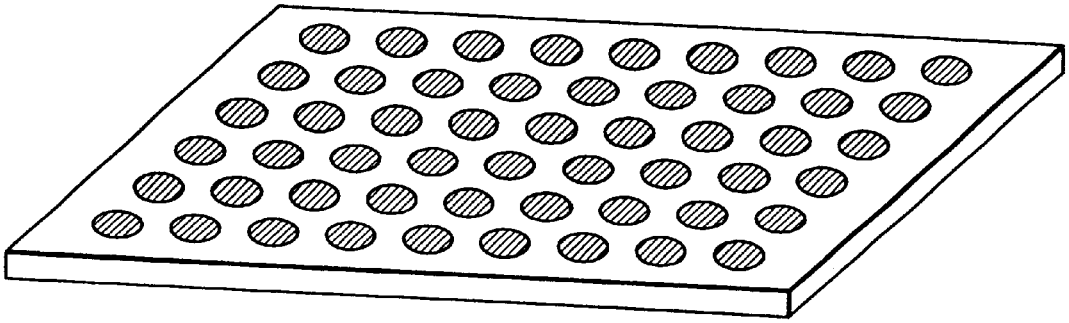
FIGS. 15A and 15B are diagrams showing examples of a spacer.
Figure 15B:
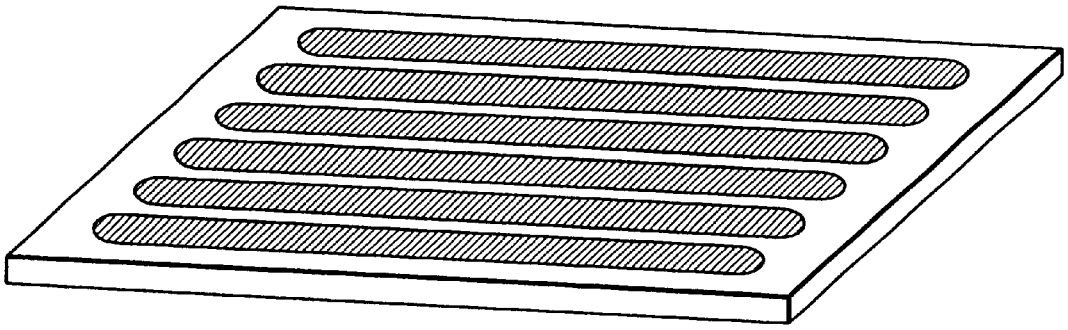

The spacer 22 is made of an insulating base material 24 whose surface is coated with a carbon nitride film 23 (the base material 24 is not necessarily required to be insulative). The spacer 22 is provided in order to prevent the vacuum container or envelope from being broken or deformed by the atmospheric pressure. The material, shape, and layout of the spacers 22 and the number of spacers 22 are determined in accordance with the shape, thermal expansion coefficient, and the like of the vacuum container, and the heat, atmospheric pressure, and the like applied to the vacuum container. The spacer may take a flat plane shape, a cross shape, an L-character shape, a cylindrical shape, or the like. The spacer may be a flat plane having holes corresponding to each electron beam source such as shown in FIG. 15A, or a flat plane having elongated holes each corresponding to a plurality of electron beam sources.

The insulating base material preferably has a thermal expansion coefficient same as that of the rear plate formed with electron emitting elements and the face plate formed with a fluorescent film. The insulating base material 24 may be a material having a high elasticity easy to absorb thermal deformation. In order to be resistant to the atmospheric pressure applied to the face plate 19 and rear plate 17, the material having a high mechanical strength and a high heat resistance such as glass and ceramics is preferable. If glass is used as the materials of the face plate 19 and rear plate 17, the insulating base material 24 of the spacer 22 is preferably glass or a material having the same thermal expansion coefficient as the glass, in order to suppress thermal stress during the manufacture processes of the flat display.

The present inventor has vigorously studied various materials which prevent charge-up of the spacer, and has found that a carbon nitride ($CN_x$) film is very excellent. The carbon nitride film ideally has a chemical formula of $C_3N_4$ which is a compound made of nitrogen and carbon atoms covalent-bonded together on $sp^3$ mixed orbits. As will be later described, a carbon nitride film can be formed by various methods. In actual, the carbon nitride film is a mixture of a $C_3N_4$ structure made of $Sp^3$ mixed orbits like diamond and a structure that some carbons of graphite ($sp^2$) extending in hexagonal plane are replaced by nitrogen atoms. If the carbon nitride film has a perfect $C_3N_4$ structure, an atomic ratio N/C is about 1.3 which changes with each manufacture method and condition. If the N composition is small, the specific resistivity becomes small.

A first point that carbon nitride is excellent as the spacer material, is a small secondary emission ratio. According to the measurements made by the present inventor, the secondary emission ratio of the carbon nitride film is 1.8 at a maximum. A second point is a large discharge breakdown voltage. The measurements in vacuum showed no discharge even in excess of 8 kV/mm. The carbon nitride film with these two advantages makes it difficult for the spacer to be charged during electron emission, and allows a sufficiently large voltage to be applied to the fluorescent film. The carbon nitride is therefore a material suitable for the spacer of the image forming apparatus using electron beams.

As will be later described, the carbon nitride film can be formed as either an insulating film or a conductive film. In both cases of the insulating film and the conductive film, carbon nitride is suitable for the spacer material because carbon nitride has the above characteristics.

The carbon nitride film used by this invention is formed on the insulating base material of the spacer, through thin film forming methods such as reactive sputtering, ion plating, ion assist vapor deposition, and CVD. If sputtering is used, a target graphite is sputtered in a nitrogen gas atmosphere or an atmosphere of a mixture gas of nitrogen and argon. The resistance can be controlled by changing the nitrogen partial pressure or the film forming rate.

Baked carbon nitrogen powders with binders may be used. In this invention, the surface of the spacer is formed with carbon nitride. The invention is not limited to the embodiments to be described later.

The function of the spacer 22 will be described. If the carbon nitride film 23 is insulative, the nitrogen composition of the carbon nitride film is high and the carbon nitride film contains a large amount of $C_3N_4$ on $sp^3$ orbits. Such a carbon nitride film can be obtained, for example, through reactive sputtering under the conditions of a high nitrogen partial pressure of the sputtering gas and a relatively slow film forming rate. When electrons emitted from the cold cathode electron source 14 or reflected from the face plate collide with the spacer 22, the spacer 22 emits secondary electrons. If the number of emitted secondary electrons is larger than the number of incident electrons (i.e., if the secondary emission rate is 1 or larger), the spacer surface is charged positively. The secondary electrons emitted from the spacer surface are attracted to the face plate by the acceleration voltage Va, and some electrons become again incident upon the spacer by positive charge. The secondary electrons again incident upon the spacer have a small energy so that the secondary emission ratio is 1 or smaller.

Specifically, since the number of incoming electrons becomes larger than the number of outgoing electrons, the positive charge of the spacer is neutralized. If the charge of the spacer becomes large and the potential rise amount $\Delta V$ at, a certain position of the spacer becomes large, as the number of electrons incident upon the spacer becomes large, the number of incoming electrons becomes large correspondingly. As a result, the potential rise amount to be caused by the charge-up of the spacer will not increase infinitely, but at a certain charge amount, the number of incoming electrons and the number of outgoing electrons reach an equilibrium point. In other words, the spacer increases its charge amount until it reaches the equilibrium point maintaining a certain charge amount.

Once the charge amount reaches the equilibrium point, this charge state is maintained because the spacer is insulative and the charge accumulated on the surface thereof will not be remove in a short time.

If the spacer is charged positively, an electron beam emitted from the electron beam source 14, particularly the source 14 near the spacer 22, is attracted by the spacer and becomes difficult to be incident upon its specific position on the fluorescent film.

Carbon nitride has a small secondary emission ratio so that the charge amount becomes small or a positively charged area becomes small. Therefore, provision of the carbon nitride on the surface of the spacer formed between two opposing substrates can reduce the influence of the spacer charge upon a beam shift.

The degree of a beam shift depends upon a distance between opposing plates and a voltage applied therebetween. Use of the spacer of this invention reduces the influence of the spacer charge upon the beam shift. Therefore, if a distance between rear and face plates is not relatively longer or if a voltage applied between the two plates is not relatively smaller, then the spacer of this invention can be used as it is, without any modification. Even if the distance is relatively long or if the voltage is relatively small, the spacer of this invention is used by giving some modification. For example, electrodes to be described later are provided to make the spacer conductive and generate an electric field which imparts a force form making electrons move away from the spacer.

In the structure embodying the invention, discharge is difficult to occur. This can be ascribed to carbon nitride which suppresses an increase in a charge amount.

The carbon nitride of this invention can be used as insulator or as semiconductor having a conductivity. It is generally said that insulator has a volume resistance of about $10^6$ Ωcm or higher, but it is possible to define the insulator as having a resistance equal to or higher than that which cannot substantially remove (discharge) the accumulated charges of the spacer by a potential difference applied across two different positions of the spacer (e.g., an acceleration voltage Va). Namely, as described above, the spacer is used in a saturated charge state without substantially varying the charges accumulated on the spacer surface.

That the spacer is conductive, means the state capable of flowing current through the spacer, the current allowing charges on the spacer surface to be quickly removed. Therefore, the resistance suitable for the spacer is determined in accordance with the charge amount. The charge amount depends upon the current emitted from an electron source and the secondary emission ratio of the spacer surface. A large current is not required to be flowed, because the carbon nitride has a small secondary emission ratio. If the sheet resistance is $10^{12}$ Δcm, this carbon nitride can possible be used under most of usage conditions, and it is sufficient if the sheet resistance is $10^{11}$ Δ or lower. If the specific resistance is $10^6$ Δcm or lower, the sheet resistance is $10^{12}$ Δ, assuming that the thickness of a carbon nitride film is in a range to be described in the following. A lower limit of the resistance is determined by a power consumption of the spacer, and the spacer resistance is required to be set to such a value that a total power consumption of the image forming apparatus is not increased excessively and therefore does not greatly influence the heat generation of the apparatus.

The thickness of carbon nitride formed on the spacer base material is preferably in the range from 1 nm or thicker to 1 μm or thinner. The reason for this is given hereinunder.

Although it is sufficient if the carbon nitride is coated on at least some surface of the spacer base material, if the thickness thereof becomes 10 nm or thinner, a continuous and uniform film is difficult to be formed. This tendency becomes conspicuous at the thickness of 5 nm or thinner. If the film thickness becomes too thin, an area of carbon nitride formed on the spacer surface becomes too small. It is therefore preferable from the viewpoint of charge suppression to set the film thickness to lnm or thicker, or more preferably to 5 nm or thicker. Furthermore, there is a possibility that electrons incident upon the spacer enter the spacer down to some depth. If charges generated by the electrons entered from the surface into the inside of the spacer are required to be suppressed, the film thickness is set to an electron transmission distance or thicker. If the film thickness is 100 nm or thicker, almost all electrons cannot transmit therethrough. If the film thickness is 1 μm or thicker, there is an ample possibility that the film is peeled off because a film stress becomes large or because of other reasons, and also a film forming time becomes long so that productivity is lowered. It is therefore preferable that the film thickness is in the range from 1 nm or thicker to 1 μm or thinner.

A carbon nitride film becomes insulative if it is manufactured under the condition of a high reaction between carbon and nitrogen atoms, i.e., a large nitrogen composition. In the case of reactive sputtering, the resistance of carbon nitrogen becomes high if the nitrogen partial pressure is made high, although it depends on each film forming system and manufacture conditions. Under the same nitrogen partial pressure, an insulating carbon nitride film can be formed at a low film forming rate. A conductive carbon nitride film has a low nitrogen composition. If reactive sputtering is used, the resistance becomes lower, the lower the nitrogen partial pressure and the higher the film forming rate.

Another method of imparting conductivity to a carbon nitride film is to add metal elements to an insulating carbon nitride film. For example, the resistance of a carbon nitride film can be lowered by adding noble metal such as Pt and Au. Elements such as Cr, Ta, Ti and W, which become low resistance nitride when reacted with nitrogen, can be used as addition elements for lowering the resistance of a carbon nitride film.

The spacer 22 is electrically connected to a metal back 21 and an X-direction wiring line 15, and an acceleration voltage Va is applied between opposite ends of the spacer 22. In FIG. 1, although the spacer 22 is connected to the wiring line, it may be connected to electrodes formed in a different manner. An intermediate electrode plate or the like may be passed between the face plate 19 and rear plate 17 for shaping an electron beam or preventing the spacer from being charged, or the spacer may be electrically connected to the face plate 19 and rear plate 17 via respective intermediate electrode plates or the like.

The display panel will be further detailed.

Structure of Display Panel (Rear Plate)

A substrate 13 is fixed to the rear plate 17. On this substrate 13, N×M cold cathode elements 14 are formed. N and M are a positive integer of 2 or larger and are determined according to the number of display pixels. For a display panel used with a high definition television, it is desired to set N=3000 and M=1000 or larger. The N×M cold cathode elements are wired in a simple matrix pattern with M direction wiring lines 15 and N column direction wiring lines 16. A portion constituted of the substrate 13, row direction wiring lines 15 and column direction wiring lines 16 is called a multi-electron-beam source.

The multi-electron-beam source of the image forming apparatus: of this invention has cold cathode elements disposed in a simple matrix pattern, and the material and shape of each cold cathode element and the manufacture method thereof are not intended to be limitative. For example, other cold electrode elements may also be used such as surface conductivity type electron emitting elements, FE type elements, and MIM type elements. The electron source may be formed directly on the rear plate.

Next, the structure of a multi-electron-beam source will be described which has surface conductivity type electron emitting elements (the details thereof will be later described) as cold cathode elements disposed on a substrate in a simple matrix pattern.

Figure 3:
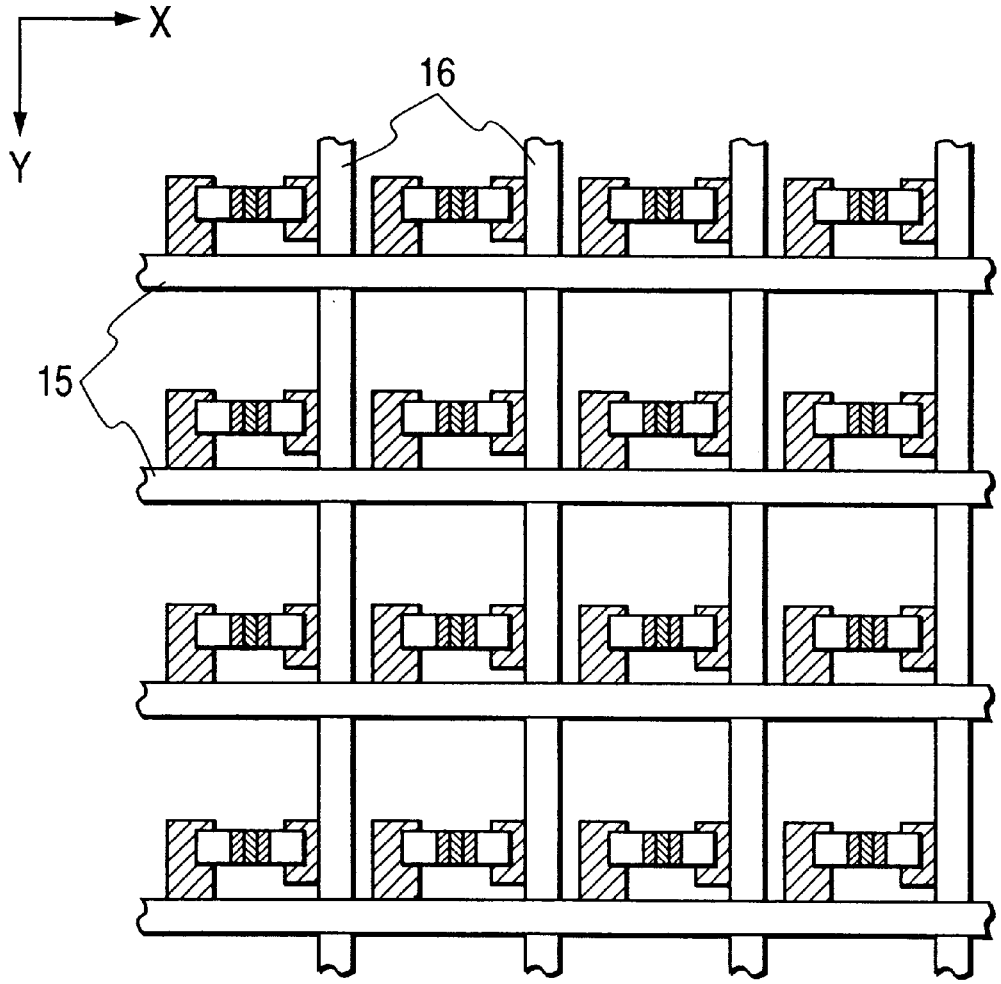
FIG. 3 is a plan view of a substrate of a multi-electron-beam source.
Figure 4A:
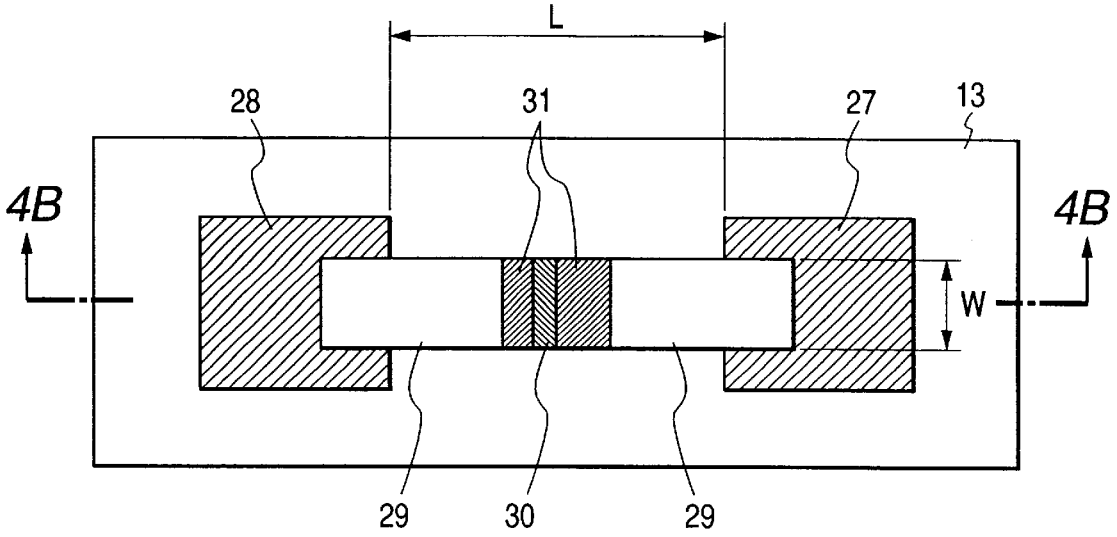
FIG. 4A is a plan view of a surface conductivity type electron emitting element of a horizontal type.
Figure 4B:
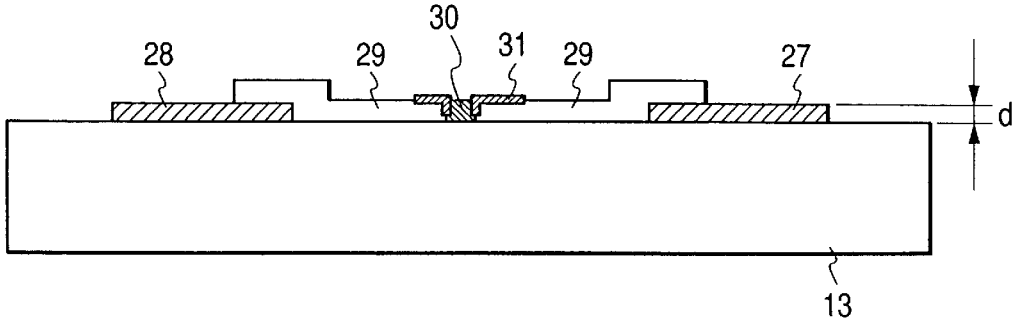
FIG. 4B is a cross sectional view of FIG. 4A.

FIG. 3 is a plan view of the raulti-electron-beam source used with the display panel shown in FIG. 2. On the substrate 13, surface conductivity type electron emitting elements like those shown in FIGS. 4A and 4B are disposed in a simple matrix pattern along the row direction wiring lines 15 and column direction wiring lines 17. Each cross area between the wiring lines 15 and 16 is formed with an insulating layer (not shown) interposed between the lines to maintain electrical insulating therebetween.

The multi-electron-beam source of this structure was formed by forming on the substrate the row direction wiring lines 15, column direction wiring lines 16, inter-line insulating layers (not shown), and element electrodes and a conductive thin film respectively of each surface conductivity electron emitting element, and by flowing current to each element via the row and column direction wiring lines 15 and 16 to perform an energization forming process (the details thereof will be later described) and an energization activating process (the details thereof will be later described).

In this example, the substrate 13 of the multi-electron-beam source is fixed to the hermetically sealed container. If the substrate 13 of the multi-electron-beam source has a sufficient mechanical strength, the substrate 13 of the multi-electron-beam source itself may be used as the rear plate 17 of the hermetically sealed container.

(Face Plate)

Figure 5A:
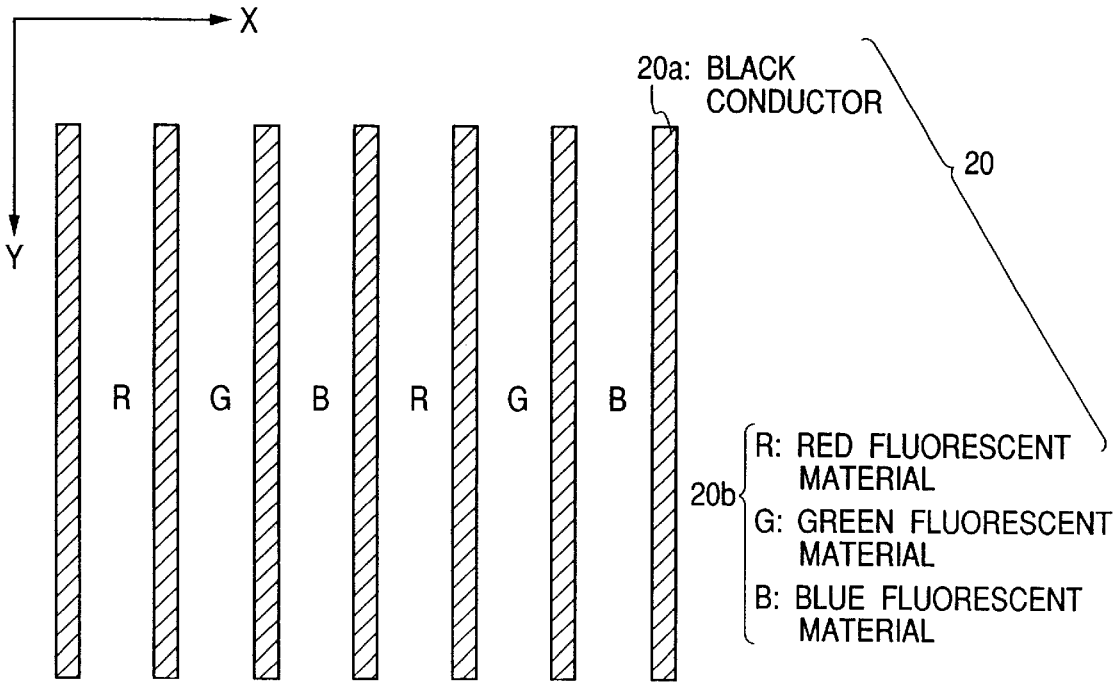
FIGS. 5A and 5B are plan views showing examples of a layout of a fluorescent film on a face plate of the display panel.

A fluorescent film 20 is formed on the lower surface of the face plate 19. In this example, a color display panel is used. Fluorescent materials of three primary colors, red, green, and blue are divisionally painted on the fluorescent film 20, as in the field of CRT techniques. Each color fluorescent material is coated in a stripe shape as shown in FIG. 5A, and a black color material 20*a* is provided between fluorescent stripes. The black color material 20*a* is provided in order not to generate a color shift even if there is some displacement of an electron beam position, in order to prevent the display contrast from being lowered by intercepting external light reflection, and for other purposes. If the black color material 20*a* is made conductive, the charge-up of the fluorescent film to be caused by an electron beam can be prevented. The black color material 20*a* was mainly made of black lead. If the above objects can be achieved, any other materials may also be used.

Figure 5B:
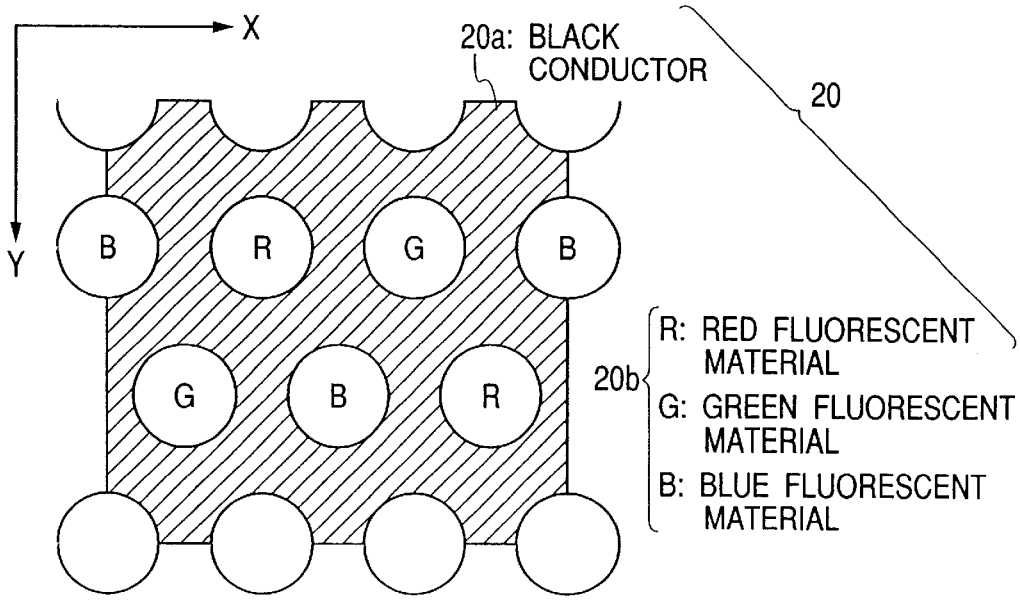

The fluorescent film of three primary colors may be painted in a delta pattern shown in FIG. 5B or in other patterns different from the stripe pattern shown in FIG. 5A.

If a monochromatic display panel is used, a monochromatic fluorescent material is painted to from the fluorescent film 20, and the black color material is not necessarily required.

A metal back 21 well known in the field of CRT techniques is provided on the fluorescent film 20 on the real plate side. The objects of the metal back 21 are, for example, to improve a light usage factor by mirror-reflecting some of light emitted from the fluorescent film 20, to protect the fluorescent film 20 from collision with negative ions, to use the metal back 21 as an electrode for applying the electron beam acceleration voltage, and to use the fluorescent film 20 as a conductive path of electrons excited in the fluorescent film 20. The metal back 21 was formed by forming the fluorescent film 20 on the face plate 19 and thereafter smoothing the surface of the fluorescent film 20 and depositing Al thereon through vapor deposition. If low voltage fluorescent material is used as the fluorescent film 20, the metal back 21 may not used in some cases.

Although not used in this example, a transparent electrode made of, for example, ITO, may be formed between the face plate 19 and fluorescent film 20 for the application of the acceleration voltage and for the improvement of conductivity.

(Assembly of Spacer)

As shown in FIG. 1, the spacer 22 has the insulating material 24 whose surface is covered with a carbon nitride film 23 and with low resistance films 25. The low resistance films 25 are formed on opposite abut surfaces and nearby side surfaces of the spacer, the abut surfaces facing the inner side (such as metal back 21) of the face plate 19 and the inner side (row or column direction wiring line 15) of the substrate 13. The spacers are provided as many as sufficient for achieving the objects of the spacers described above, disposed at a predetermined pitch and adhered by junction members 26 to the inner side of the face plate 19 and to the inner side of the substrate 13. The carbon nitride film is formed on the surface of the insulating material 24 at least on the surface area exposed in the vacuum in the hermetically sealed container. The spacer is electrically connected, via the low resistance films 25 of the spacer 22 and the junction members 26, to the inner side (such as metal back 21) of the face plate 19 and the inner side (row or column direction wiring line 15) of the substrate 13. In this example, the spacer 22 has a thin plate shape, is disposed in parallel to the row direction wiring line 16 and electrically connected thereto. If the carbon nitride film 23 is insulative, the low resistance films 25 are not necessarily used. One of the junction members 26 on the face plate 19 side and on the row direction wiring line 15 side may be omitted.

The low resistance films 25 constituting the spacer 22 are provided for obtaining a good electrical connection between the carbon nitride film 23 and the face plate 19 (metal back 21) on the high potential side and the substrate 17 (wiring lines 15 and 16) on the low potential side. In the following, the low resistance films 25 are called intermediate electrode layers (intermediate electrodes). The intermediate electrode layers (intermediate electrodes) have a plurality of functions enumerated hereinunder.

(1) Electrically connecting the carbon nitride film 23 to the face plate 19 and substrate 13.

As already described above, the conductive carbon nitride film is provided in order to prevent charges from being accumulated on the surface of the spacer 22. If the carbon nitride film 23 is connected directly or via the junction members 26 to the face plate 19 (metal back 21) and substrate 13 (wiring lines 15 and 16), a large contact resistance may be formed at the junctions thereof so that charges on the spacer surface cannot be removed quickly. In order to avoid this, the low resistance intermediate electrodes are provided on the abut surfaces and nearby side surfaces where the face plate 19, substrate 13 and junction members 26 are made in contact with the intermediate electrodes.

(2) Uniforming the potential distribution of the carbon nitride film 23.

The orbit of electrons emitted from the cold cathode element 14 is formed in accordance with the potential distribution generated between the face plate 19 and substrate 13. In order not to disturb the orbit near the spacer 22, it is necessary to control the potential distribution of the carbon nitride film 22 over the whole length of the spacer. If the carbon nitride film 23 is connected directly or via the junction members 26 to the face plate 19 (metal back 21) and the substrate 13 (wiring lines 15 and 16), the potential of the carbon nitride film 23 is disturbed by the contact resistance at the junctions, and there is a possibility that the potential distribution of the carbon nitride film 23 is displaced from a desired distribution. In order to avoid this, the low resistance intermediate electrodes are provided on the spacer end areas (abut surfaces and nearby side surfaces) where the spacer 22 abuts on the face plate 19 and substrate 13, to thereby control the whole potential distribution of the carbon nitride film 23 by applying a desired potential to the intermediate electrodes.

(3) Controlling the orbit of emitted electrons.

The orbit of electrons emitted from the cold cathode element 14 is formed in accordance with the potential distribution generated between the face plate 19 and substrate 13. Regarding electrons emitted from a cold cathode element near the spacer, some restrictions (such as changing wiring line and element positions) may be given by the spacer. If the spacer is insulative, charges may form a distortion of an electric field near the spacer. In order to form an image without distortion and variation, it is necessary to control the orbit of emitted electrons to thereby apply electrons to a desired position on the face plate 19. The low resistance intermediate electrodes provided on the surfaces near the abut surfaces upon the face plate 19 and substrate 13 allow the potential distribution near the spacer 22 to have a desired distribution and allow the orbits of emitted electrons to be controlled.

The low resistance film 25 as the intermediate electrode is made of a material having a resistance sufficiently lower than that of the carbon nitride film 23. The material is selected from: metals such as Ni, Cr, Au, Mo, W, Pt, Ti, Al, Cu and Pd or alloys thereof; printed conductive material made of glass, metal, metal oxide or the likes such as Pd, Ag, Au, $RuO_2$, Pd—Ag; transparent conductive material such as $In_2O_3$—$SnO_2$; and semiconductor material such as polysilicon.

The junction member 26 is required to be conductive so that the spacer 22 can be electrically connected to the row direction wiring line 15 and metal back 21. The material of the junction member 26 is preferably frit glass added with conductive adhesive, metal particles, or conductive filler.

(Assembly of Hermetically Sealed Container)

The rear plate, face plate, spacers, and support frame are adhered together by frit glass. The container is connected to an unrepresented exhaust pipe and a vacuum pump to evacuate the inside of the container to a vacuum degree of about $10^{-5}$ Pa. Thereafter, the exhaust pipe is sealed. In this case, in order to maintain the vacuum in the hermetically sealed chamber, a getter film (not shown) is provided at a predetermined position in the hermetically sealed chamber. For example, the getter film is formed by heating and vapor depositing getter material mainly containing Ba with a heater or through high frequency heating. An absorption function of the getter film can maintain the inside of the hermetically sealed chamber at a vacuum degree of $1\times10^{-3}$ to $1\times10^{-5}$ Pa.

In FIG. 2, Dx1 to Dxm, Dy1 to Dyn, and Hv represent electrical terminals of an air tight structure for electrically connecting the display panel to unrepresented external electronic circuits. Dx1 to Dxm are electrically connected to the row direction wiring lines 15 of the multi-electron-beam source, Dy1 to Dyn are electrically connected to the column direction wiring lines 16 of the multi-electron-beam source, and Hv is electrically connected to the metal back 21 of the face plate.

As a voltage is applied via the external terminals Dx1 to Dxm and Dy1 to Dyn to each cold cathode element 14, electrons are emitted from the cold cathode element 14. At the same time, a high voltage of several kV is applied via the external terminal Hv to the metal back 21 to accelerate the emitted electrons and make them collide with the inner surface of the face plate 19. Each color fluorescent material of the fluorescent film 20 is excited and generates light to display an image.

Generally, a voltage applied to the surface conductivity type electron emitting element 14 of this invention used as the cold cathode electrode is about 12 to 16 V, a distance between the metal back 21 and cold cathode element 14 is about 1 mm to 8 mm, and a voltage applied across the metal back 21 and cold cathode element 14 is about 3 kV to 5 kV.

Structure and Manufacture Method of Multi-electron-beam Source

Next, a method of manufacturing a multi-electron-beam source used with the display panel of the embodiment will be described. The multi-electron-beam source of the image forming apparatus of this invention has cold cathode elements disposed in a simple matrix pattern, and the material and shape of each cold cathode element and the manufacture method thereof are not intended to be limitative. For example, other cold electrode elements may also be used such as surface conductivity type electron emitting elements, FE type elements, and MIM type elements.

Of these cold cathode elements, the surface conductivity type electron emitting element is particularly preferable if an inexpensive display panel having a large display screen is to be formed. Specifically, with the FE type electron emitting element, the relative position and shape of an emitter cone and gate electrode greatly influence the electron emission characteristics, and high precision manufacture techniques are required, which becomes a contradictory factor of realizing a large screen area and a low cost manufacture. With the MIM type electron emitting element, the insulating film and upper electrode are required to be thin and uniform, which also becomes a contradictory factor of realizing a large screen area and a low cost manufacture. In contrast, with the surface conductivity type electron emitting element, the manufacture method is relatively simple so that it is easy to realize a large screen area and a low cost manufacture. The present inventor has found that a surface conductivity type electron emitting element having its electron emitting portion or its nearby area made of a fine particle film has excellent electron emission characteristics and can be manufactured easily. Therefore, such an electron emitting element is most suitable for using it as the multi-electron-beam source for a high luminance and large screen image forming apparatus. In view of this, the display panel of the embodiment used an electron emitting element having its electron emitting portion or its nearby area made of a fine particle film. The basic structure, manufacture method, and characteristics of a preferred surface conductivity type electron emitting element will first be described and then the structure of a multi-electron-beam source having a number of elements disposed in a simple matrix will be described.

The typical structure of a surface conductivity type electron emitting element having its electron emitting portion or its nearby area made of a fine particle film has the following two types, a horizontal type and a vertical type.

(Surface conductivity type electron emitting element of horizontal type)

First, the structure and manufacture method of a surface conductivity type electron emitting element of a horizontal type will be described. FIG. 4A is an enlarged plan view of one element shown in FIG. 3, illustrating the structure of a surface conductivity type electron emitting element of a horizontal type, and FIG. 4B is a cross sectional view taken along line 4B—4B of FIG. 4A. In FIGS. 4A and 4B, reference numeral 13 represents a substrate, reference numerals 27 and 28 represent element electrodes, reference numeral 29 represents a conductive thin film, reference numeral 30 represents an electron emitting portion formed through an energization forming process, and reference numeral 31 represents a thin film formed by an energization activating process.

The substrate 13 may be one of various types of glass substrates such as quartz glass and blue plate glass, various types of ceramic substrates such as alumina, and these substrates laminated with an insulating film made of, for example, $SiO_2$.

The element electrodes 27 and 28 formed on the substrate 13 in parallel with the substrate surface are made of conductive material. The conductive material to be used is selected from metals such as Ni, Cr, Au, Mo, W, Pt, Ti, Cu, Pd, and Ag, alloys of these metals, metal oxide such as $In_2O_3$—$SnO_2$, and semiconductor such as polysilicon. For example, the electrode can be formed easily by using a combination of a film forming technique such as vacuum vapor deposition and a patterning technique such as photolithography and etching. The other techniques such as printing technique may also be used in forming the electrodes 27 and 28.

The shapes of the electrodes 27 and 28 are designed as desired, in accordance with an application field of the electron emitting element. Generally, a distance L between electrodes is usually designed by selecting a suitable value in a range from several hundreds angstroms to several hundreds micrometers. A range from several micrometers to several tens micrometers is particularly suitable for the application field of a display panel. A thickness d of the element electrode is generally selected in a range from several hundreds angstroms to several micrometers.

A fine particle film is used for the conductive thin film 29. The fine particle film is intended to be a film having a plurality of fine particles including an aggregation of fine particle islands. According to a microscopic observation of the fine particle film, the particles are disposed spaced from each other, adjacent to each other, or overlapped each other.

The diameter of a fine particle of the fine particle film is in a range from several angstroms to several thousands angstroms, or preferably in a range from 10 angstroms to 200 angstroms. The thickness of the fine particle film is set properly by taking the following conditions into consideration. Namely, the conditions include the condition of maintaining a good electrical connection to the element electrode 27 or 28, the condition of reliably performing the energization forming process to be described later, the condition of setting the resistance of the fine particle film to a proper value, and other conditions. The film thickness is practically selected in a range from several angstroms to several thousands angstroms, and more preferably in a range from 10 angstroms to 500 angstroms.

The materials of the fine particle film may be metals such as Pd, Pt, Ru, Ag, Au, Ti, In, Cu, Cr, Fe, Zn, Sn, Ta, W, and Pb, oxides such as PdO, $SnO_2$, $In_2O_3$, PbO, and $Sb_2O_3$, borides such as $HfB_2$, $ZrB_2$, $LaB_6$, $CeB_6$ $YB_4$, and $CdB_4$, carbides such as TiC, ZrC, HfC, TaC, SiC and WC, nitrides such as TiN, ZrN, and HfN, semiconductors such as Si and Ge, and carbons. From these materials, a proper one is selected as desired.

The sheet resistance of the fine particle film as the conductive thin film 29 was set in a range from $10^3$ to $10^7$ ohms/□.

Since it is desired that the conductive thin film 29s are electrically connected reliably to the element electrodes 27 and 28, they are structured being partially overlapped. This overlap state is realized by a lamination of the substrate, element electrode, and conductive thin film stacked in this order from the bottom as shown in FIG. 4B, or may be realized by a lamination of the substrate, conductive thin film, and element electrode stacked in this order from the bottom.

The electron emitting portion is an area having cracks partially formed in the conductive thin film 29, and has a higher electrical resistance than the nearby conductive thin film. These cracks can be formed in the conductive thin film 29 by performing the energization forming process to be described later. In some cases, fine particles having a diameter in a range from several angstroms to several hundreds angstroms are present in cracks. The electron emitting portion is schematically shown in FIGS. 4A and 4B because the actual position and shape thereof are difficult to draw precisely and correctly.

The thin film 31 is made of carbon or carbon compound and covers the electron emitting portion 30 and its nearby area. This thin film 31 can be formed by performing the energization activating process to be described later, after the energization forming process is performed.

The thin film 31 is made of one of single crystal graphite, polycrystalline graphite, and amorphous carbon, and a mixture thereof. The film thickness is set to 500 angstroms or thinner, or preferably 300 angstroms or thinner.

A preferred basic structure of the element has been described. In this embodiment, an element described hereinunder was used.

Specifically, blue plate glass was used as the substrate 13. Ni thin films were used as the element electrodes 27 and 28. The thickness d of the element electrode was 1000 angstroms and the electrode distance L was 10 micrometers.

Pd or PdO was used as the main material of the fine particle film. The thickness of the fine particle film was set to about 100 angstroms, and the width W thereof was set to 100 micrometers.

Next, a method of manufacturing a surface conductivity type electron emitting element of a horizontal type according to a preferred embodiment will be described.

FIGS. 6A to 6D are cross sectional views illustrating the manufacture method of a surface conductivity type electron emitting element. In FIGS. 6A to 6D, components similar to those shown in FIGS. 4A and 4B are represented by using identical reference numerals.

Figure 6A:
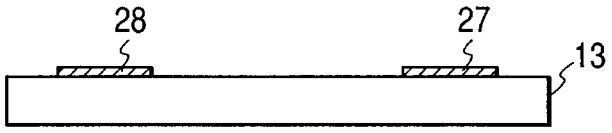
FIGS. 6A, 6B, 6C, and 6D are cross sectional views illustrating the manufacture processes of a surface conductivity type electron emitting element of a horizontal type.

1) First, as shown in FIG. 6A, element electrodes 27 and 28 are formed on a substrate 13.

Specifically, after the substrate 13 is sufficiently cleaned with cleaner, pure water, and organic solution, material of the element electrodes is deposited by vacuum film forming technique such as vapor deposition and sputtering. The deposited electrode material is patterned by photolithography and etching techniques to form a pair of element electrodes 27 and 28 shown in FIG. 6A.

Figure 6B:
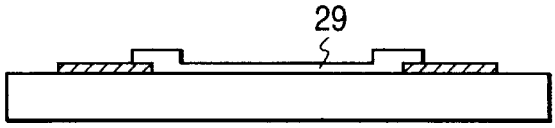

2) Next, as shown in FIG. 6B, a conductive film 29 is formed.

Specifically, organic metal solution is coated on the substrate formed with the pair of element electrodes 27 and 28 shown in FIG. 6A, and dried to be subjected to a heating and baking process to form a fine particle film. Thereafter, this fine particle film is patterned into a predetermined shape by photolithography and etching. The organic metal solution is a solution of organic metal compound having elements of fine particles of a conductive film material as its main component. In this embodiment, the main element is Pd, and the organic metal solution is coated on the substrate through dipping. Other coating method such as spinning and spraying may also be used.

Instead of forming the conductive thin film made of the fine particle film by coating organic metal solution as in this embodiment, it may be formed through vacuum vapor deposition, sputtering, or chemical vapor deposition.

Figure 6C:
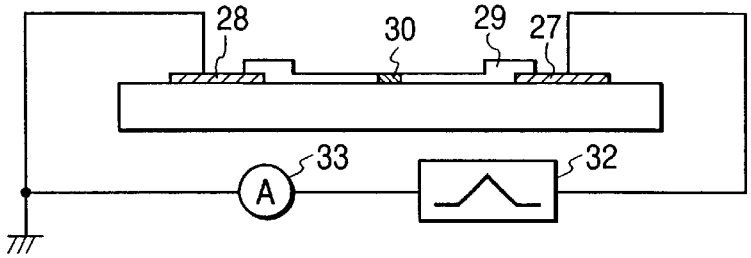

3) Next, as shown in FIG. 6C, an appropriate voltage is applied between the element electrodes 27 and 28 from a forming power source 32 to perform an energization forming process and form an electron emitting portion 30.

The energization forming process is a process of supplying a power to the conductive thin film 29 made of the fine particle film to partially break, deform or decompose the film 29 and provide the structure of the film suitable for electron emission. Of the conductive film made of the fine particle film, the area (electron emitting portion 30) having the structure suitable for electron emission is a thin film formed with proper gaps. As compared to the conductive thin film 29 before the electron emitting portion 30 is not formed, the conductive thin film 29 with the electron forming area 30 has a considerably increased electrical resistance between the element electrodes 27 and 28.

Figure 7:
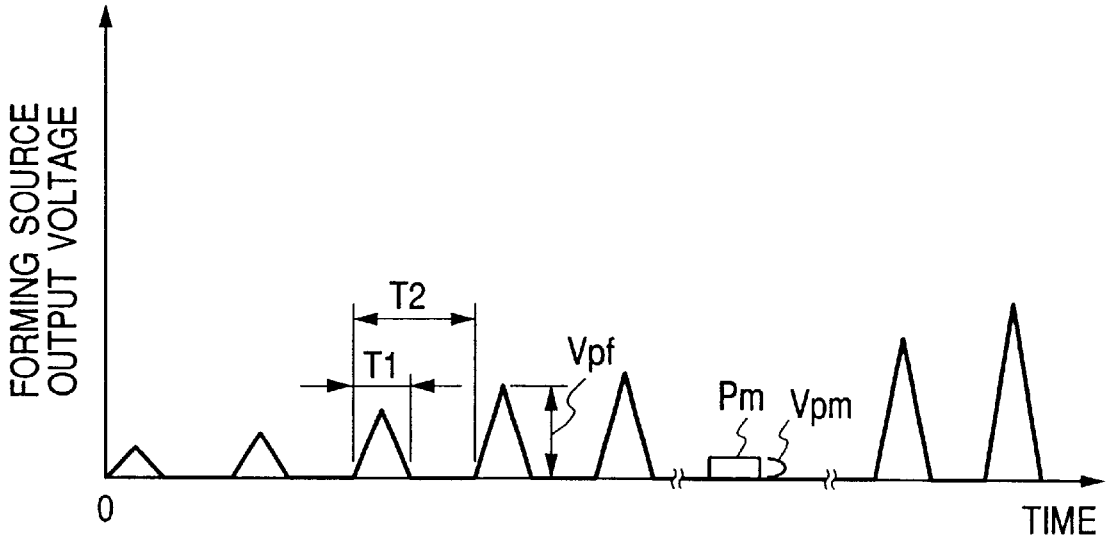
FIG. 7 is a diagram showing the waveform of an applied voltage in an energization forming process.

In order to further detail the energization forming process, an example of a suitable voltage waveform supplied from a forming source 32 is shown in FIG. 7. In order to perform the energization forming process of the conductive thin film made of the fine particle film, a pulsating voltage is preferable. In this embodiments, as shown in FIG. 7, triangle pulses having a pulse width T1 were continuously applied at a pulse period T2. In this case, the peak value Vpf of the triangle pulse was gradually raised. In order to monitor the formation state of the electron emitting portion 30, monitor pulses Pm were inserted among the triangle pulses at a proper interval and the current caused by the monitor pulse was measured with an ammeter.

In the embodiment, for example, under the vacuum atmosphere of about $10^{-3}$ Pa, the pulse width T1 was set to 1 msec, the pulse period T2 was set to 10 msec, and the peak value VpE was raised 0.1 V. Pea one pulse. Every time five triangle pulses were applied, one monitor pulse Pm was applied. In order not to adversely affect the energization forming process, the voltage Vpm of the monitor pulse was set to 0.1 V. The energization forming process was stopped when the electrical resistance between the element electrodes 27 and 28 reached $1\times10^{6}$ Ω, i.e., when the current measured with the ammeter 33 when the monitor pulse was applied reached $1\times10^{-7}$ A or lower.

The above method is suitable for use with the surface conductivity type electron emitting element of this embodiment. It is preferable to change the conditions of the energization forming process with a change in the design of the surface conductivity type electron emitting element, such as the material or thickness of the fine particle film and the element electrode distance L.

Figure 6D:
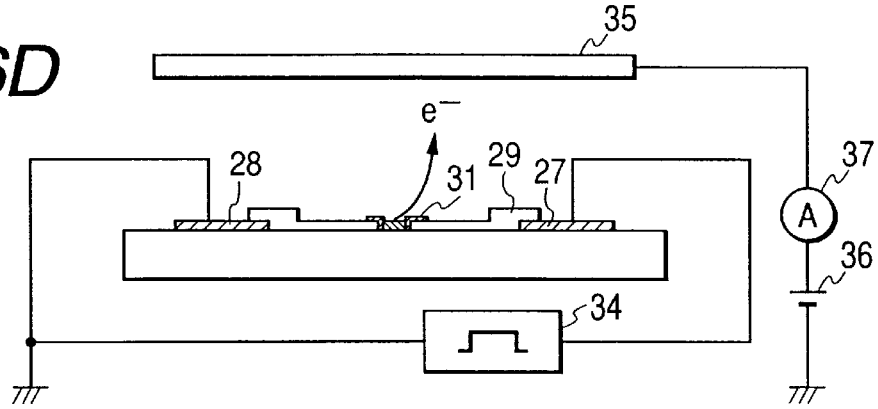

4) Next, as shown in FIG. 6D, an appropriate voltage is applied between the element electrodes 27 and 28 from an activation source 34 to perform the energization activating process and improve the electron emission characteristics.

The energization activating process is a process of supplying a power to the electron emitting portion 30 formed by the (energization forming process, under the proper conditions, and depositing carbon or carbon compound on the area near the electron emitting portion 30. In FIG. 6D, a carbon or carbon compound deposited member 31 is shown in a schematic diagram. With the energization activating process, the emission current can be increased typically by one hundredfold or more at the same applied voltage, as compared to the case before the energization activating process.

More specifically, under the vacuum atmosphere of $10^{-2}$ to $10^{-4}$ Pa, a voltage pulse is periodically applied to deposit carbon or carbon compound in organic compound present in the vacuum atmosphere. The deposited member 31 is one of single crystal graphite, polycrystalline graphite, amorphous carbon, and their mixture, and has a film thickness of 500 angstroms or thinner, or more preferably 300 angstroms or thinner.

Figure 8A:
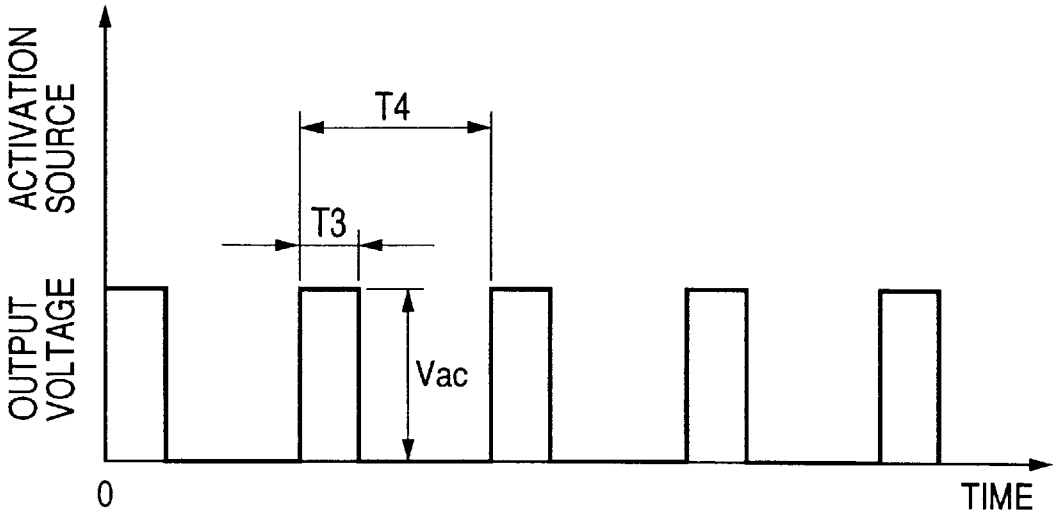
FIG. 8A is a diagram showing the waveform of an applied voltage in an energization activating process.

In order to further detail the energization activating process, an example of a suitable voltage waveform supplied from the activation source 34 is shown in FIG. 8A. In order to perform the energization activating process, a predetermined voltage of a rectangular waveform was periodically applied in this embodiment. Specifically, a rectangular voltage Va was set to 14 V, a pulse width T3 was set to 1 msec, and a pulse period T4 was set to 10 msec. The above energization conditions are preferable for the surface conductivity type electron emitting element of this embodiment.

It is preferable to change the conditions of the energization activating process with a change in the design of the surface conductivity type electron emitting element.

Figure 8B:
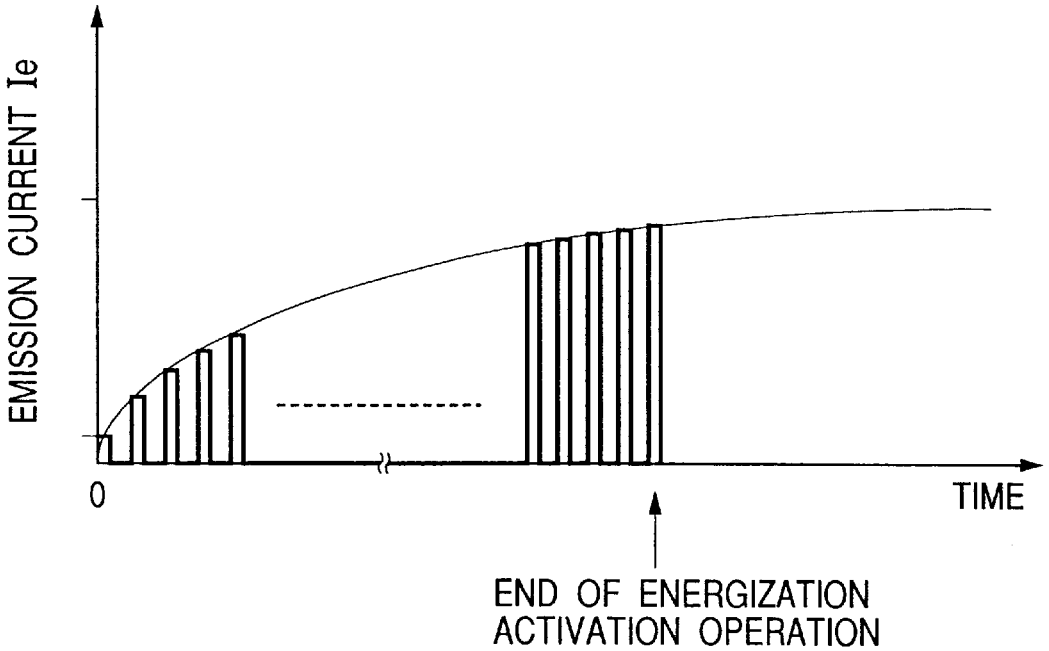
FIG. 8B is a graph showing a change in an emission current Ie.

In FIG. 6D, reference numeral 35 represents an anode electrode for capturing currently emitted from the surface conductivity type electron emitting element, the anode electrode being connected to a DC high voltage source 36 and an ammeter 37. If the energization activating process is performed after the substrate 13 is assembled in the display panel, the fluorescent film of the display panel is used as the anode electrode 35. While the voltage is applied from the activation source 34, the emission currently Ie is measured with the ammeter 37 to monitor the advancement of the energization activating process and control the operation of the activation source 34. An example of the emission current le measured with the ammeter 37 is shown in FIG. 8B. As the pulse voltage is applied from the activation source 34, the emission current Ie starts increasing as the time lapses, and eventually saturates and thereafter hardly increases. When the emission current le reaches nearly the saturated point, the voltage application by the activation source 34 is stopped to terminate the energization activating process.

The above energization conditions are preferable for the surface conductivity type electron emitting element of this embodiment. It is preferable to change the conditions of the energization activating process with a change in the design of the surface conductivity type electron emitting element.

In the above manner, the surface conductivity type electron emitting element of a horizontal type shown in FIG. 4 was manufactured.

(Surface conductivity type electron emitting element of vertical type)

Next, the structure of another typical surface conductivity type electron emitting element whose electron emitting portion and its nearby area are made of a fine particle film, i.e., a surface conductivity type electron emitting element of a vertical type, will be described.

Figure 9:
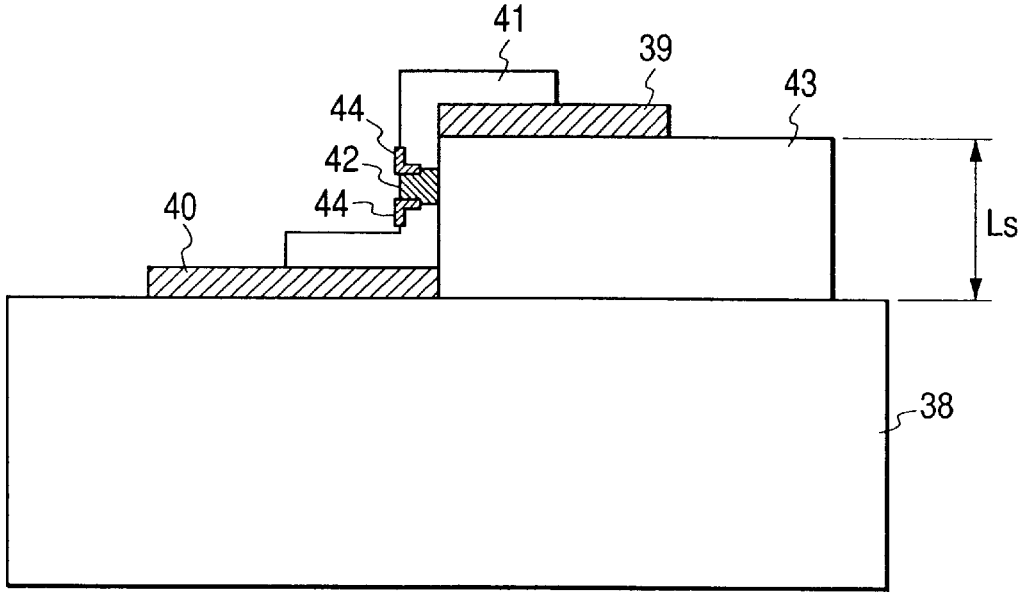
FIG. 9 is a cross sectional view of a surface conductivity type electron emitting element of a vertical type.

FIG. 9 is a schematic cross sectional view illustrating the basic structure of the vertical type electron emitting element. In FIG. 9, reference numeral 38 represents a substrate, reference numerals 39 and 40 represent element electrodes, reference numeral 43 represents a step forming member, reference numeral 41 represents a conductive thin film made of a fine particle film, reference numeral 42 represents an electron emitting portion formed through an energization forming process, and reference numeral 44 represents a thin film formed by an energization activating process.

Different points of the vertical type electron emitting element from the horizontal type electron emitting element described earlier are that one element electrode 39 is formed on the step forming member 43, and that the conductive thin film 41 covers the side wall of the step forming member 43. Therefore, the element electrode distance L of the horizontal type shown in FIG. 4 is defined as a step height Ls of the step forming member 43 in the case of the vertical type. The materials of the substrate 38, element electrodes 39 and 40, and conductive thin film 41 made of the fine particle film may use the same materials as enumerated for the horizontal type electron emitting element described previously. The step forming member 43 is made of electrically insulating material such as $SiO_2$.

Next, a method of manufacturing a surface conductivity type electron emitting element of a vertical type will be described.

FIGS. 10A to 10E are cross sectional views illustrating the manufacture method. In FIGS. 10A to 10E, components similar to those shown in FIG. 9 are represented by using identical reference numerals.

Figure 10A:
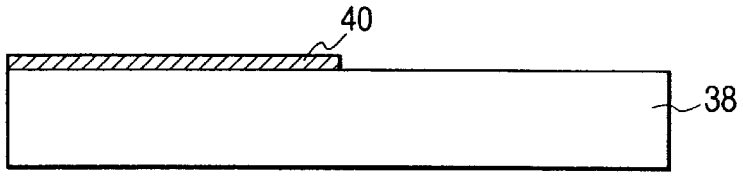
FIGS. 10A, 10B, 10C, 10D, and 10E are cross sectional views illustrating the manufacture processes of a surface conductivity type electron emitting element of a vertical type.

1) First, as shown in FIG. 10A, an element electrode 40 is formed on a substrate 38.

Figure 10B:
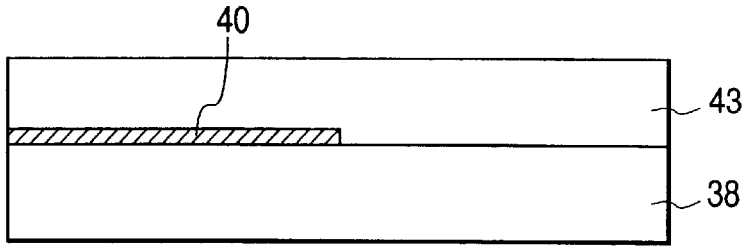

2) Next, as shown in FIG. 10B, an insulating film is stacked upon the substrate to form a step forming member. For example, the insulating layer is formed by sputtering $SiO_2$. Other film forming methods such as vacuum vapor deposition and printing may also be used.

Figure 10C:
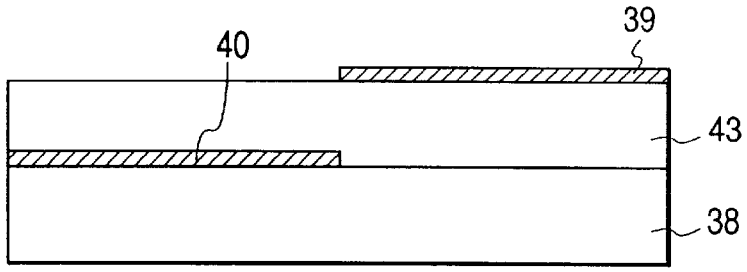

3) Next, as shown in FIG. 10C, an element electrode 39 is formed on the insulating layer.

Figure 10D:
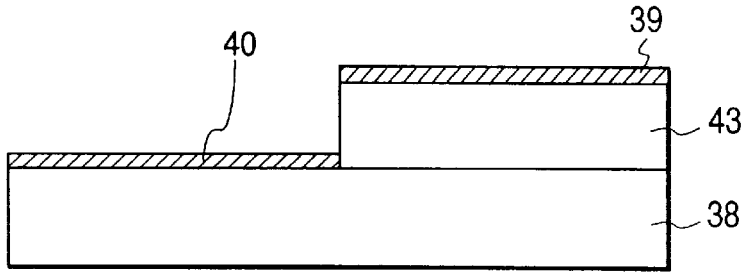

4) Next, as shown in FIG. 10D, the insulating film is partially removed, for example, by etching, to expose the element electrode 40.

Figure 10E:
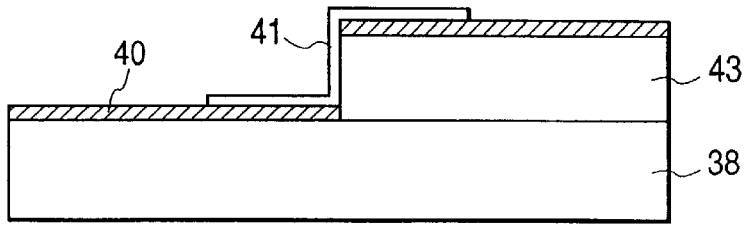

5) Next, as shown in FIG. 10E, a conductive thin film 41 is formed by using a fine particle film. Similar to the horizontal type, the conductive thin film is formed by the film forming technique such as coating.

6) Next, similar to the horizontal type, the energization forming process is performed to form an electron emitting portion. In this case, the process is performed which is similar to the energization forming process used for the horizontal type and described with reference to FIG. 6C.

7) Next, similar to the horizontal type, the energization activating process is performed to deposit carbon or carbon compound on an area near the electron emitting portion. In this case, the process is performed which is similar to the energization activating process used for the horizontal type and described with reference to FIG. 6D.

In the above manner, the surface conductivity type electron emitting element of a vertical type shown in FIG. 9 was manufactured.

(Characteristics of surface conductivity type electron emitting element used with display panel)

In the above, the structures and manufacture methods of surface conductive type electron emitting elements of the horizontal and vertical types have been described. Next, the characteristics of the electron emitting element used with a display panel will be described.

Figure 11:
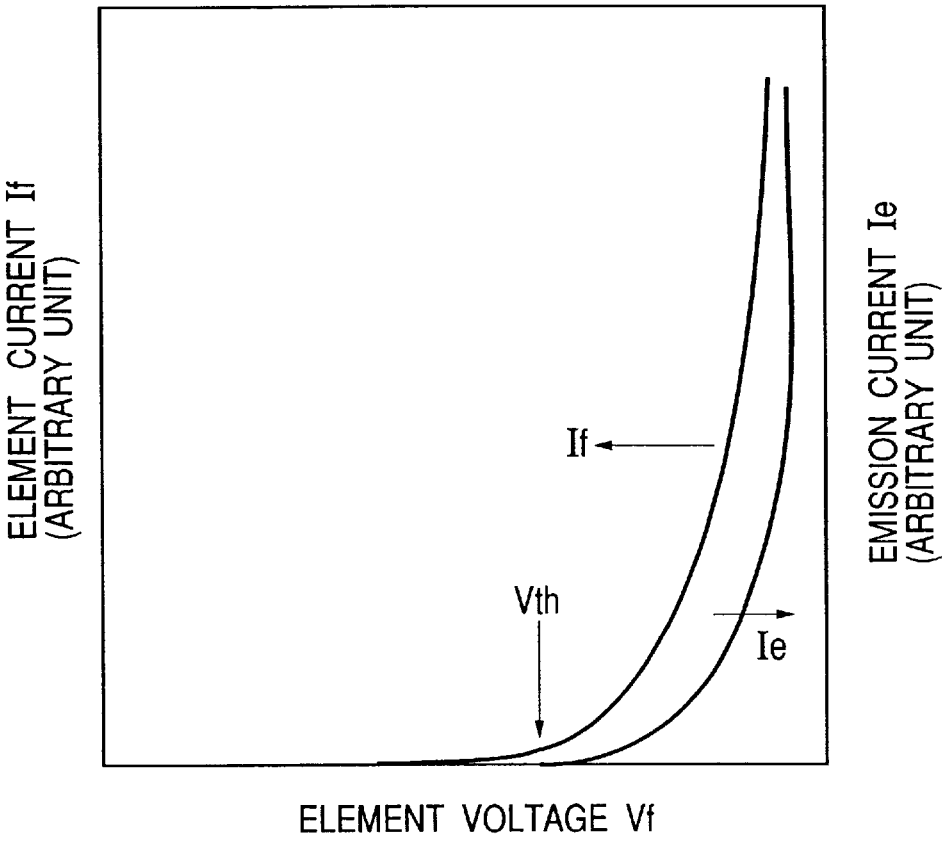
FIG. 11 is a graph showing typical characteristics of a surface conductivity type electron emitting element.
Figure 12:
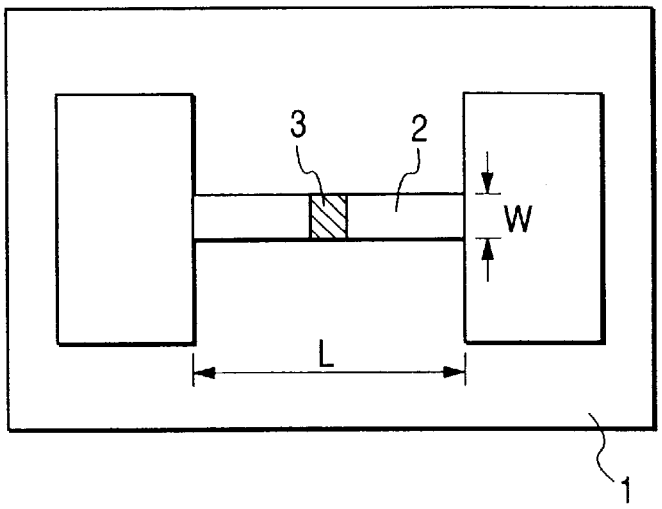
FIG. 12 is a plan view showing an example of a conventional surface conductivity type electron emitting element.
Figure 13:
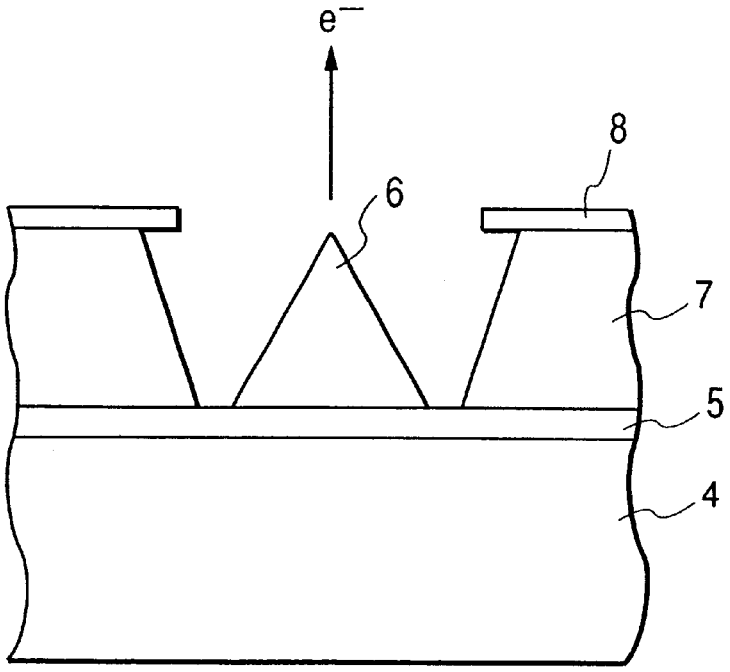
FIG. 13 is a schematic diagram showing an example of a conventional FE type element.
Figure 14:
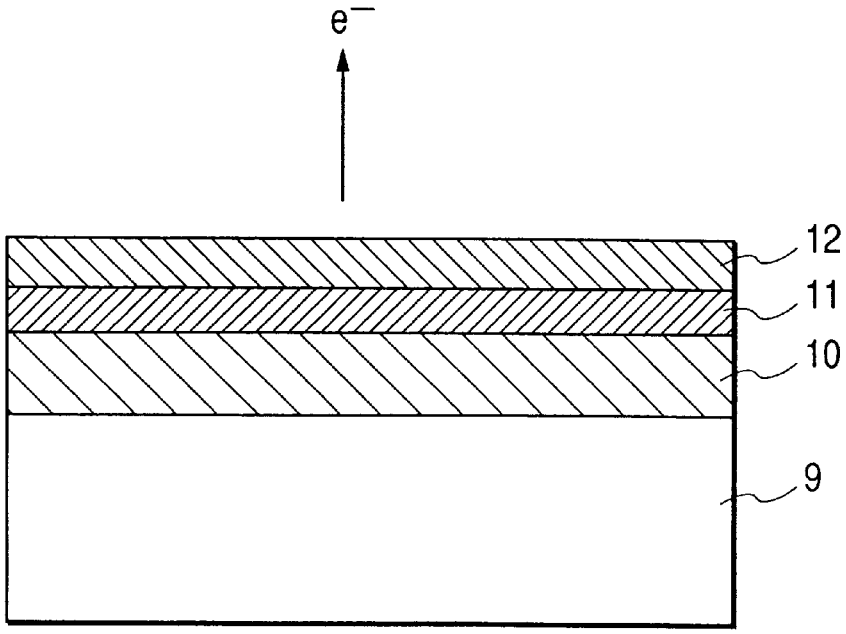
FIG. 14 is a schematic diagram showing an example of a conventional MIM type element.

FIG. 11 shows typical examples of the characteristics of an emission current Ie and an element current If relative to an element voltage Vf of the electron emitting element used with the display panel. The emission current Ie is considerably smaller than the element current If. It is therefore difficult to show both the currents in one graph. The characteristics change with the size and shape of an element and the design parameters. Therefore, in this graph, two curves are shown by arbitrary units.

Elements used with the display panel have the following three characteristics with respect to the emission current.

First, as a voltage equal to or higher than a certain voltage (called a threshold voltage Vth) is applied to the element, the emission current Ie increases abruptly, whereas as a voltage smaller than the threshold voltage Vth is applied, the emission current Ie is hardly detected.

Namely, the element is a non-linear element having a definite threshold voltage Vth relative to the emission current Ie.

Second, since the emission current Ie depends on the voltage Vf applied to the element, the magnitude of the emission current Ie can be controlled by the voltage Vf.

Third, a response speed of the emission current Ie relative the voltage Vf applied to the element is fast. Therefore, the amount of charges emitted from the element can be controlled by the time duration while the voltage Vf is applied.

Since the element has the above characteristics, the surface conductivity type electron emitting element could be used properly with the display panel. For example, in the case of a display panel having a number of elements disposed in correspondence with pixels on a display screen, a sequential scan of the display screen is possible by using the first characteristic. Specifically, a voltage equal to or larger than the threshold voltage Vth is applied to the driven element in accordance with a desired luminance, and a voltage lower than the threshold voltage Vth is applied to non-selected elements, By sequentially changing driven elements, the display screen can be sequentially scanned and an image can be displayed.

By using the second or third characteristic, the luminance can be controlled so that a gradation display is possible.

Specific embodiments of the invention will be described with reference to the accompanying drawings.

FIRST EMBODIMENT

The first embodiment will be described with reference to FIG. 2. In this embodiment, a plurality of surface conductivity type electron sources 14 still not subjected to the energization forming process were formed on the substrate 13. A cleaned blue plate glass was used as the substrate 13, and 160×720 surface conductivity type electron emitting elements shown in FIGS. 4A and 4B were disposed in a matrix shape. The element electrodes 27 and 28 are an Ni sputtered film. The X-direction and Y-direction wiring lines 15 and 16 are Ag wiring lines formed through screen printing. The conductive thin film 29 is a PDO fine particle film formed by baking Pd amine complex solution.

The fluorescent film 20 as an image forming member has fluorescent stripes of respective colors extending in the Y direction as shown in FIG. 5A. The black color material 20*a* is disposed not only between fluorescent stripes of respective colors, but also in the X-direction to thereby separate pixels in the Y direction and reserve the areas for mounting the spacers 22. The black color material (conductive material) 20*a* was first formed, and then fluorescent materials of respective colors were coated in spaces formed by the black color material to form the fluorescent film 20. As the material of the black stripe (black color material 20*a*), material whose main component is black lead commonly used was used. Fluorescent material was coated on a face plate by a slurry method.

The metal back 21 to be mounted on the inner surface side of the fluorescent film 20 on the electron source side was formed by smoothing (normally called filming) the inner surface side of the fluorescent film 20 formed on the face plate 19, and thereafter by depositing Al through vacuum vapor deposition. In order to raise conductivity of the fluorescent film 20, the face plate 19 is provided in some cases with a transparent electrode on the outer surface side of the fluorescent film 20 (between glass substrate and fluorescent film). However, in this embodiment, it was omitted because only the metal back can provide sufficient conductivity.

Referring to FIG. 1, the spacer 22 was formed by depositing a carbon nitride film 23 through vacuum vapor deposition on the cleaned insulating base material 24 (plate of 1.0 mm wide, 200 $\mu$m thick, 20 mm long) made of soda lime glass. The carbon nitride film used in the embodiment was formed by sputtering a graphite target in a nitrogen atmosphere by using a sputtering system.

Nitrogen was introduced into a film forming chamber and the pressure during the film formation was maintained at 5 mTorr. A high frequency voltage was applied across the target and the spacers and substrate to generate discharge and perform sputtering. A power of 1.3 W/cm$^2$ was applied to the target, and the film thickness was 180 nm.

The intermediate electrodes 25 made of Al were placed at the about surfaces of the spacer 22 in order to ensure a reliable electrical connection to the X-direction wiring line and metal back and maintain the potentials constant. The intermediate electrode 25 fully covered the four sides of the spacer 22 by 50 $\mu$m from the X-direct,ion wiring line toward the face plate and by 100 $\mu$m from the metal back toward the rear plate.

Thereafter, the face plate 19 was mounted on the support frame 18 at the position 1.2 mm higher than the electron source 14, and the rear plate 13, face plate 19, support frame 18, and spacers 22 were adhered together at their junctions. The spacers were fixed at an equal pitch on the X-direction wiring lines 15. Electrical conduction between the carbon nitride film 23 of the spacer 22 and the face plate 19 on the black color material 20*a* (line width of 300 $\mu$m) was ensured by using the conductive frit glass 26 containing silica balls coated with Au. The metal back 21 was partially removed in the area where the metal back 21 and spacer 22 are coupled. The rear plate 17 and support frame 18 were adhered together at the junction by coating frit glass (not shown) and baking it at 420° C. for 10 minutes or longer in the atmospheric air.

The display panel completed in the above manner was connected to the vacuum pump via the exhaust pipe to evacuate the inside thereof. After a sufficiently low pressure was obtained, a voltage was applied via the external terminals Dx1 to Dxm and Dy1 to Dyn across the element electrodes 27 and 28 to make the conductive films 29 be subjected to the energization forming process and to form the electron emitting portions 30. The energization forming process was performed by applying a voltage having the waveform shown in FIG. 7.

Next, acetone was introduced via the exhaust pipe into the vacuum chamber to reach a pressure of 0.013 Pa. By periodically applying a voltage pulse to the external terminals Dx1 to Dxm and Dy1 to Dyn, the energization activating process of depositing carbon or carbon compound was performed. The voltage having the waveform shown in FIG. 8A was applied for the energization activating process.

Next, while the vacuum chamber was heated to 200° C., the inside of the vacuum chamber was evacuated for 10 hours. At the inside pressure of about $10^{-4}$ Pa, the exhaust pipe was heated with a gas burner to melt it and hermetically seal the vacuum chamber.

Lastly, a getter process was performed in order to maintain the pressure after the sealing.

With the image forming apparatus completed in the above manner, a scan signal and a modulation signal generated from an unrepresented signal generator were applied via the external terminals Dx1 to Dxm and Dy1 to Dyn to each electron emitting element 14 to emit therefrom electrons, and a high voltage was applied via the high voltage terminal Hv to the metal back 21 to accelerate the emitted electron beam and make it collide with the fluorescent film 20, to thereby excite the fluorescent material 20*b* and generate light and display an image. The voltage Va applied to the high voltage terminal Hv was set to 1 to 5 kV, and a voltage Vf applied across the element electrodes 27 and 28 was set to 14 V. The resistance value of the spacer was $10^{13}$ Ω or higher which was over a measurement limit of the resistance meter, confirming a sufficient insulating function.

In this embodiment, it was possible to apply an acceleration voltage Va up to 5 kV without any discharge, and a practically sufficient luminance of the image forming apparatus was obtained. A beam shift caused by charges on the spacer was small and an image of a good quality was able to display.

The image forming apparatuses completed in the above manner were disassembled and the carbon nitride films 23 of the spacers 22 were analyzed. For this analysis, ESCA (X-ray photoelectron spectroscopy), Raman spectroscopy, and XRD (X-ray diffraction) were used.

The analysis results of XRD showed no particular diffraction peak and indicated that the carbon nitride film had an amorphous structure as a whole.

The analysis results of Raman spectroscopy showed peaks caused by a six-membered ring structure of graphite or a structure similar thereto.

Figure 16:
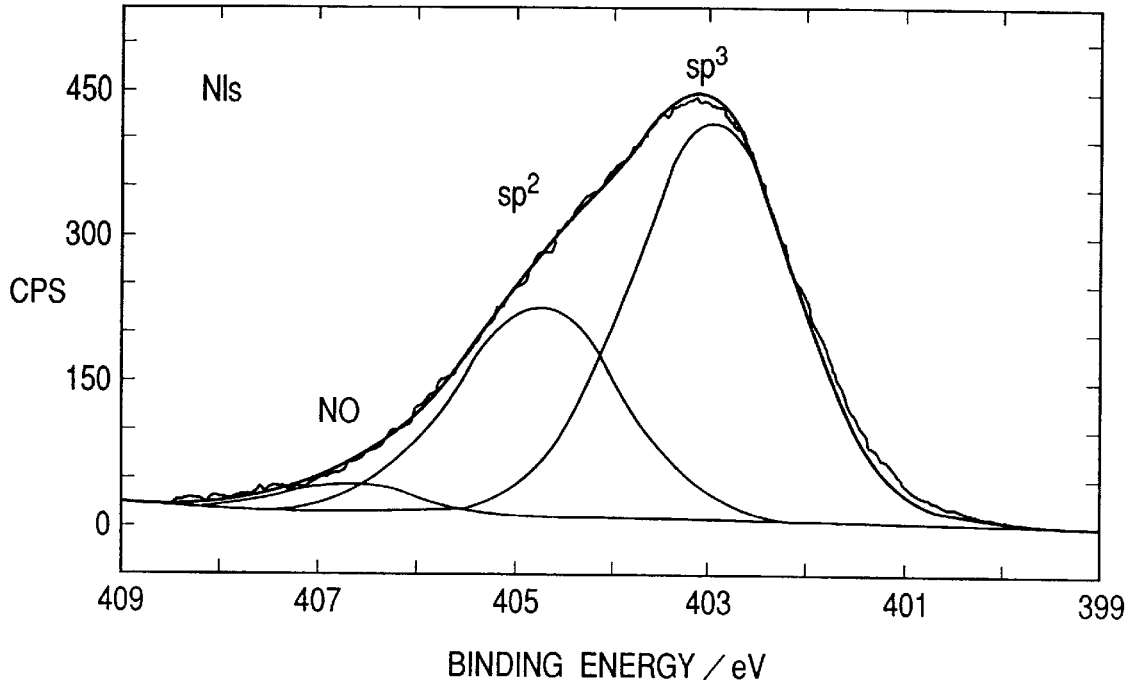
FIGS. 16 and 17 are graphs illustrating ESCA spectra and peak separations of nitrogen and carbon.
Figure 17:
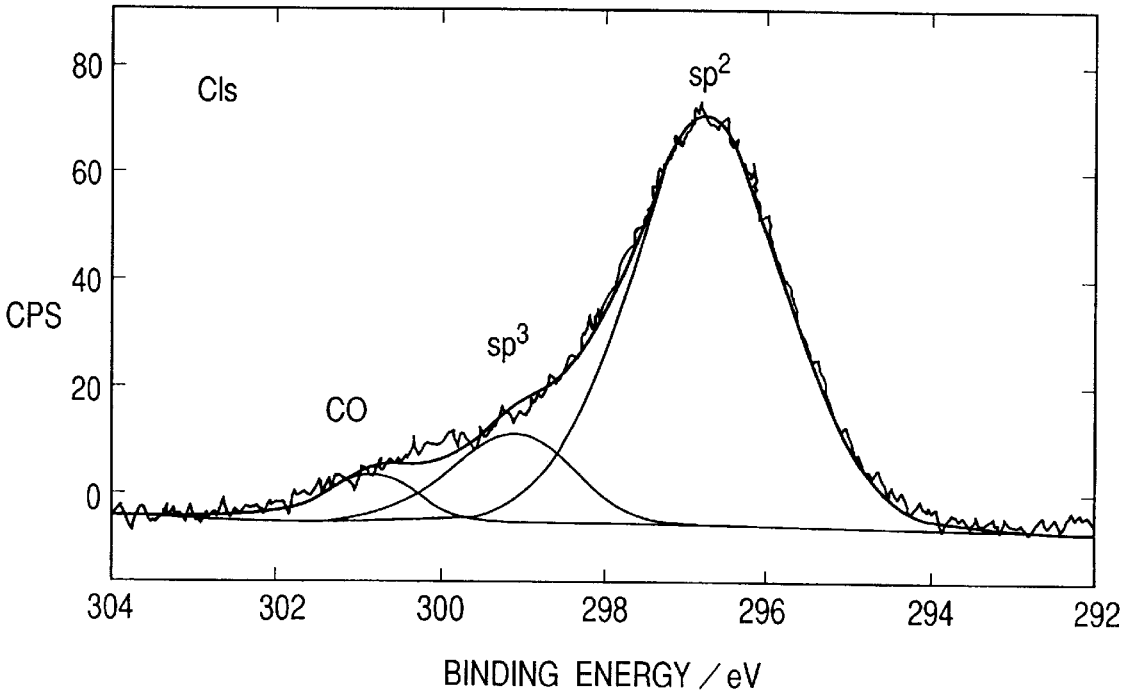

With ESCA, the state analysis and surface element determination of carbon and nitrogen were performed. ESCA spectra and peak separations of nitrogen and carbon are shown in FIGS. 16 and 17. Cls peak separation for carbon showed three peaks attributed to $sp^3$ components, $Sp^2$ components, and CO. Peak separation for nitrogen also showed three peaks attributed to $Sp^3$ components, $sp^2$ components, and NO. It is common that the position of a peak may shift more or less by the manufacture method and later processing. However, it is known that there is a general tendency as in the following. First, if nitrogen and carbon are bonded on the $sp^2$ orbits, the energy difference between the nitrogen $sp^2$ peak and carbon $sp^2$ peak is about 114.7 eV. The embodiment samples show the energy difference of 114.1 eV which is comparable with 114.7 eV. Second, if nitrogen and carbon are bonded on the $Sp^3$ orbits, the energy difference between the nitrogen $Sp^3$ peak and carbon $Sp^3$ peak is possible about 112.9 eV. The embodiment samples show the energy difference of 112.3 eV which is comparable with 112.9.

In summary of these analysis results, it can be supposed that the carbon nitride film has a structure containing both a $C_3N_4$ structure formed on the $Sp^3$ orbits and a graphite like structure (some carbon atoms replaced by nitrogen atoms) formed by the $Sp^2$ orbits.

Determination of elements of the embodiment samples by ESCA showed that carbon was 56.7% (atomic %), nitrogen was 38.2 (atomic %), and oxygen was 5.1 (atomic %). Determination results showed that the amount of oxygen contained in the film was very small, and that the film was made of nitrogen and carbon having substantially the same structure described above.

COMPARATIVE EXAMPLE 1

As a comparative example, a substrate of soda lime glass was used as the spacer without forming a cover of a carbon nitride film, and an image forming apparatus was manufactured by using such spacers by the processes similar to those of the first embodiment. The secondary emission rate of the glass is nearly 3.5. With this comparative example, creeping discharge occurred on the spacer surface at an acceleration voltage Va of 2.5 kV and a sufficient luminance was unable to obtain. Electrons from the electron emitting element nearest to the spacer were deflected toward the spacer by charges on the spacer, and a distortion of the image was confirmed at this position.

SECOND EMBODIMENT

In the second embodiment, the insulating base material 24 of the spacer and the assembly method of the electron source type display panel are quite the same as the first embodiment. However, the glass substrate had a width of 1.8 mm. Nitrogen gas was introduced into the film forming chamber and the nitrogen pressure during the film formation was maintained at 5 mTorr. A power of 1.3 W/cm$^2$ was applied to the graphite target, and a carbon nitride film having a thickness of 180 nm was formed. The carbon nitride film was formed on both sides of the glass substrate.

Next, an Al film as the intermediate electrode was formed on both sides of the spacer at width of 200 $\mu$m along one longer side. The intermediate electrode covered the spacer by 200 $\mu$m from the X-direction wiring line toward the face plate and by 100 $\mu$m from the metal back toward the rear plate. In this embodiment, the height of the intermediate electrode on the rear plate side is greater than the first embodiment. This is because it is desired to adjust the potentials by the intermediate electrodes if the distance between the rear plate and face plate is long.

The spacers 22 formed in the above manner were electrically connected to the row direction wiring lines by adhering the intermediate electrodes to the wiring lines with conductive frit glass.

The succeeding processes similar to the first embodiments were performed to complete the image forming apparatus. The different point from the first embodiment is a distance of 2 mm between the rear plate and face plate. The resistance value of the spacer was $10^{13}$ Ω or higher which was over a measurement limit of the resistance meter, confirming a sufficient insulating function.

In this embodiment, it was possible to apply an acceleration voltage Va up to 7 kV without any discharge, and an image of a good quality without any distortion to be caused by a beam shift was able to display.

THIRD EMBODIMENT

In the third embodiment, the insulating base material 24 of the spacer and the assembly method of the electron source type display panel are quite the same as the first embodiment. However, the spacer conductive film 23 used is as follows. Nitrogen gas was introduced into the film forming chamber and the nitrogen pressure during the film formation was maintained at 1.5 mTorr. A power of 3.8 W/cm$^2$ was applied to the graphite target, and a carbon nitride film having a thickness of 250 nm was formed. This carbon nitride film is used as a sample A. Next, nitrogen gas was introduced into the film forming chamber to maintain the nitrogen pressure during the film formation at 2 mTorr. A power of 3.8 W/cm$^2$ was applied to the graphite target, and a carbon nitride film having a thickness of 240 nm was formed on the insulating base material 24. This carbon nitride film is used as a sample B. Lastly, nitrogen gas was introduced into the film forming chamber to maintain the nitrogen pressure during the film formation at 2.7 mTorr. A power of 3.8 W/cm$^2$ was applied to the graphite target, and a carbon nitride film having a thickness of 210 nm was formed on the insulating base material 24. This carbon nitride film is used as a sample C. These spacers were used and a display panel was assembled. The processes are all the same as those of the first embodiment. However, the face plate and rear plate were adhered together by baking frit glass at 420° C. for 10 minutes or longer under a nitrogen atmosphere.

After the sealing process, a voltage was applied in the same polarity as the voltage Va and the resistance value (per each spacer) was measured. The sample A was $7.1\times10^8$ Ω, the sample B was $1.2\times10^9$ Ω, and the sample C was $1.1\times10^{10}$ Ω. The sheet resistance was in the order of $10^9$ for the samples A and B, and in the order of $10^{10}$ for the sample C.

With the image forming apparatus completed in the above manner, a scan signal and a modulation signal generated from an unrepresented signal generator were applied via the external terminals Dx1 to Dxm and Dy1 to Dyn to each electron emitting element 14 to emit therefrom electrons, and a high voltage was applied via the high voltage terminal Hv to the metal back 21 to accelerate the emitted electron beam and make it collide with the fluorescent film 20, to thereby excite the fluorescent material 20*b* and generate light and display an image. The voltage Va applied to the high voltage terminal Hv was set to 1 to 5 kV, and a voltage Vf applied across the element electrodes 27 and 28 was set to 14 V.

In this embodiment, a television image was displayed through luminance modulation by changing the pulse width of the voltage Vf. With these samples A to C, there was no or a very small beam shift caused by charges on the nearby the spacer, and a television image without any problem was able to display.

The consumption power of the spacer was several tens mW even for the sample A having a smallest resistance value, and no heat problem occurred.

FOURTH EMBODIMENT

In the fourth embodiment, the insulating base material 24 of the spacer and the assembly method of the electron source type display panel are quite the same as the first embodiment. However, the spacer conductive film 23 used is as follows. Nitrogen gas was introduced into the film forming chamber and the nitrogen pressure during the film formation was maintained at 5 mTorr. A power of 3.8 W/cm$^2$ was applied to the graphite target, and at the same time a power of 0.4 W/cm$^2$ was applied to a Pt target. Both the graphite and Pt were sputtered at the same time to obtain a carbon nitride film having a thickness of 200 nm was formed.

These spacers were used and a display panel was assembled. The processes are all the same as those of the first embodiment. However, the face plate and rear plate were adhered together by baking frit glass at 420° C. for 10 minutes or longer under a nitrogen atmosphere.

After the sealing process, a voltage was applied in the same polarity as the voltage Va and the resistance value (per each spacer) was measured. The resistance value of the spacer was $1.8\times10^{10}$ Ω.

With the image forming apparatus completed in the above manner, a scan signal and a modulation signal generated from an unrepresented signal generator were applied via the external terminals Dx1 to Dxm and Dy1 to Dyn to each electron emitting element 14 to emit therefrom electrons, and a high voltage was applied via the high voltage terminal Hv to the metal back 21 to accelerate the emitted electron beam and make it collide with the fluorescent film 20, to thereby excite the fluorescent material 20*b* and generate light and display an image. The voltage Va applied to the high voltage terminal Hv was set to 1 to 5 kV, and a voltage Vf applied across the element electrodes 27 and 28 was set to 14 V.

In this embodiment, a television image was displayed through luminance modulation by changing the pulse width of the voltage Vf. With these spacers, there was no or a very small beam shift caused by charges on the nearby spacer, and a television image without any problem was able to display.

Figure 18:
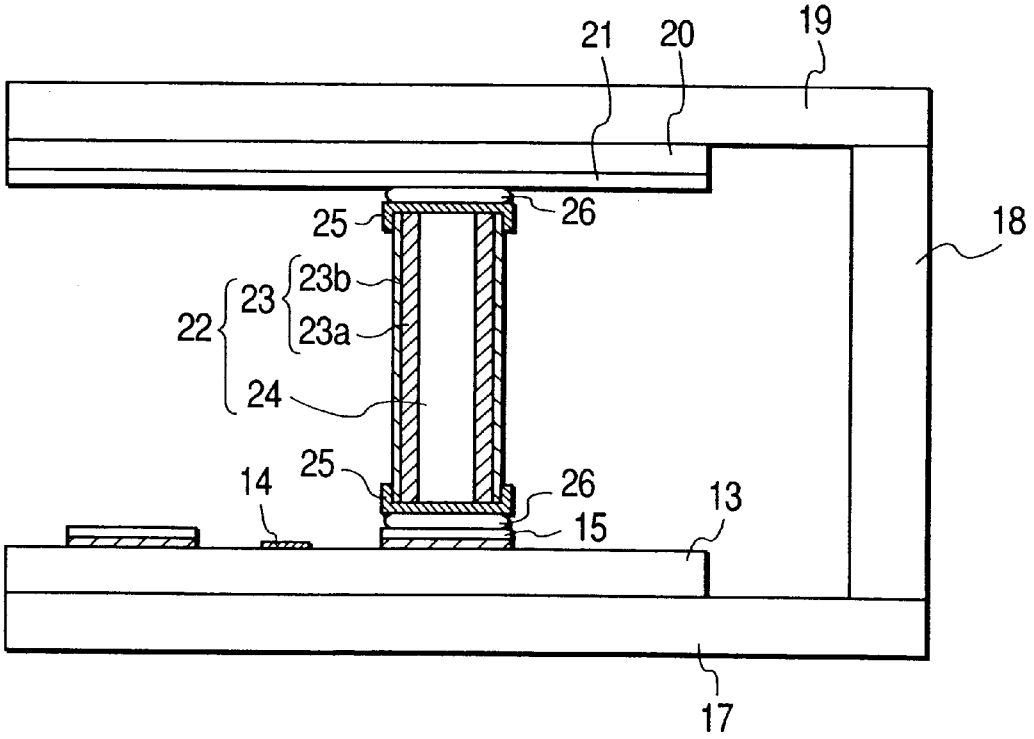
FIG. 18 is a schematic cross sectional view of a spacer and its nearby components of an image forming apparatus according to an embodiment of the invention.
Figure 19:
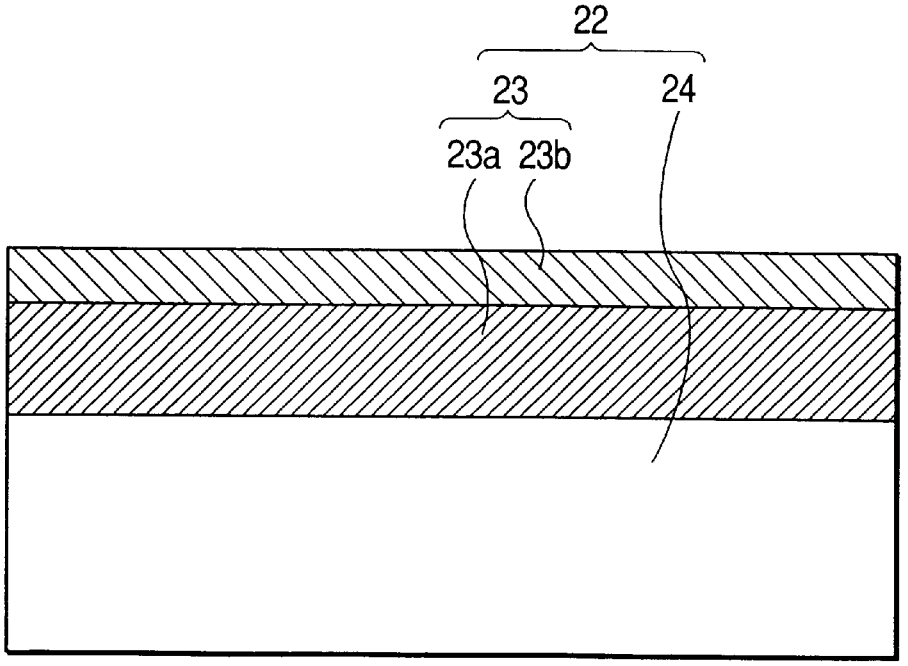
FIG. 19 is a schematic cross sectional view of a spacer according to the invention.

Next, another embodiment will be described. In the structure to be described below, carbon nitride is formed on the surface of a spacer, and charges on the surface of the spacer are made easy to be drained to the base material side of the spacer. In particular, the structure given hereinunder forms carbon nitride on a first conductive film to make it easy to drain charges. FIGS. 18 and 19 are schematic diagrams showing the structure of such a spacer. On an insulating base material 24, a conductive first layer 23*a* and a carbon nitride second layer 23*b* are formed.

The first layer removes charges on the spacer surface so as not to make the spacer have large charges. The second layer is made of material having a small secondary emission rate so as to suppress charges from being accumulated.

The resistance value of the first layer is set to a value so that current flows through the spacer sufficiently for rapidly remove charges on the spacer surface. Therefore, the resistance value suitable for the spacer is determined from the charge amount. The charge amount depends on the emission current from the electron source and the secondary emission rate of the spacer surface. However, it is not necessary to flow a large current because the carbon nitride second film has a small secondary emission ratio. Although it is conceivable that the sheet resistance of $10^{12}$ Ω or higher can satisfy most of usage conditions, the sheet resistance of $10^{11}$ Ω or higher is most desirable. The lower limit of the resistance value is determined by a power consumption of the spacer. Therefore, the resistance value of the spacer is required to be selected to a value so that the total heat of the image forming apparatus is not greatly influenced without excessively increasing it.

The first layer of the spacer is preferably made of semiconductive material rather than metal having a small specific resistivity. The reason for this is that if a material having a small specific resistivity is used, the thickness of the charge preventing film is required to be very thin in order to obtain a desired sheet resistance Rs. Generally, a thin film having a thickness of 10 nm or thinner has islands and its resistance is unstable and reproductivity is poor, although these phenomena depend on the surface energy of the thin film material, on adhesion performance to the substrate, and the substrate temperature. It is therefore preferable to use semiconductive material having its specific resistivity larger than metal and smaller than insulator.

If the temperature coefficient of the spacer is positive, the resistance increases as the temperature rises so that heat generation by the spacer can be suppressed. Conversely, if the temperature coefficient of the spacer is negative, the resistance value is lowered by the temperature rise caused by a power consumed at the spacer surface, so that heat is generated further, the temperature rises further, and a large current flows, resulting in so-called thermorunaway. This thermorunaway does not occur, however, under the conditions that the heat amount or consumption power is balanced with heat dissipation. Therefore, if the absolute value of the temperature coefficient (TCR) of the resistor is small, the thermorunaway will not occur.

It has been confirmed from experiments that if a thin film having TCR of about −1% is used and the consumption power per 1 cm$^2$ of the spacer becomes in excess of 0.1 W, the current flowing through the spacer continues to increase and a thermorunaway occurs, although the above conditions may change depending upon the spacer shape, the voltage Va applied to the spacer, and the temperature coefficient of the resistance of the charge preventing film. From the above conditions, the value Rs ensuring the power consumption of lower than 0.1 W per 1 cm$^2$ is $10\times Va^2$ Ω or higher. Namely, the sheet resistance Rs of the first layer formed on the spacer is preferably set in a range from $10\times Va^2$ Ω to $10^{11}$ Ω.

The thickness t of the first layer is preferably 10 nm or thicker as described above. If the film thickness t becomes in excess of 1 μm, a film stress becomes large posing a problem of a danger of film peel-off, and in addition the film forming time becomes long resulting in a poor productivity. It is therefore preferable to set the film thickness to 10 nm to 1 μm, or more preferably to 20 nm to 500 nm.

The specific resistivity ρ is a product of the sheet resistance Rs and the film thickness t. From the preferable ranges of Rs and t described above, it is desired that the range of the specific resistivity ρ of the charge preventing film is from $10^{-7}\times Va^2$ Ωm to $10^5$ Ωm. Furthermore, in order to realize the preferable ranges of the sheet resistance and the film thickness, it is preferable to set p in a range from $(2\times10^{-7})\times Va^2$ Ωm to $5\times10^4$ Ωm. The electron acceleration voltage Va for a display panel is 100 V or higher. In order to ensure a sufficient luminance when a high speed electron fluorescent film generally used with a CRT is used for a flat display panel, a voltage of 3 kV or higher is required. Under the condition of Va=1 kV, a preferable range of the specific resistivity of the charge preventing film is from 0.1 Ωm to $10^5$ Ωm.

The material of the first layer may be any material such as oxide and nitride so long as it is stable and can be adjusted to have a resistance value in the above-described preferred range for the spacer. Of these materials, materials which are easy to adjust the specific resistance and maintain a stable resistance value throughout the manufacture processes of an image forming apparatus, are complexes (cermets) of transition metal and ceramics such as Cr—SiO, Cr—$SiO_2$, Cr—$Al_2O_3$, and $In_2O_3$—$A1_2O_3$, complexes of transition metal and high resistance nitride (ailuminum nitride, boron nitride, silicon nitride and the like) such as Cr—Al—N, Ti—Al—N, Ta—Al—N, Cr—B—N, and Cr—Si—N.

The total resistance of the spacer is determined so that it can be defined roughly by the resistance value of the first; layer 23*a*. In order not to fluctuate the orbits of electrons emitted from an electron source, it is preferable that the potential distribution between the face plate and rear plate is uniform, i.e., the resistance value of the spacer is uniform over the whole area thereof. If the potential distribution fluctuates, electrons near the spacer are deflected and collide with an adjacent fluorescent material so that the image is distorted. A nitride film made of Cr, Ti or Ta provides a stable and uniform resistance value and is effective for preventing an image distortion.

The carbon nitride second layer ($CN_x$) has ideally a chemical formula $C_3N_4$ and is a compound of nitrogen and carbon covalent-bonded on $sp^3$ mixed orbits. The carbon nitride film can be formed by various methods to be described later. As described earlier, the carbon nitride film is a mixture of a $C_3N_4$ structure on sp3 mixed orbits like diamond and a structure that some carbons of graphite ($sp^2$) extending in hexagonal plane are replaced by nitrogen atoms. If the carbon nitride film has a perfect $C_3N_4$ structure, an atomic ratio N/C is about 1.3 which changes with the manufacture method and condition.

A first point that carbon nitride is excellent as the spacer material, is a small secondary emission ratio. According to the measurements made by the present inventor, the secondary emission ratio of the carbon nitride film is 1.8 at a maximum. A second point is a large creeping discharge breakdown voltage. The measurements in vacuum show no discharge even in excess of 8 kW/mm. The carbon nitride film with these two advantages makes it difficult for the spacer to be charged during electron emission, and allows a sufficiently large voltage to be applied to the fluorescent film. The carbon nitride is therefore a material suitable for the spacer of the image forming apparatus using electron beams.

The second layer may be insulative or conductive. However, if the resistance value is too small, it is not preferable because the resistance of the spacer becomes too low. A carbon nitride film having a large N/C is almost insulative, and it is easy to control the total resistance of the spacer.

As described earlier, the film thickness of the second film is preferably 1 nm or thicker.

With the above structure of the spacer, although the carbon nitride second layer has a small secondary emission ratio, accumulated charges are coupled to opposite polarity charges in the first layer and neutralized. Charges of the second layer are moved by diffusion or by potential gradient formed by the charges. However, the mobility is very small as compared to the conductor. Therefore, if the film thickness is too thick, it becomes difficult to remove charges quickly. If the second layer is thin even if it is insulative, charge motion by the tunneling effects can be expected so that the film thickness of the second layer is preferably set to 50 nm or thinner, from the viewpoint of moving the charges to the substrate side (to the first layer).

The first layer 23*a* can be formed on the insulating base material, through thin film forming methods such as reactive sputtering, ion beam vapor deposition, ion plating, ion assist vapor deposition, and CVD. The second layer 23*b* can be formed through reactive sputtering, ion assist vapor deposition, CVD, and ion beam sputtering. If sputtering is used, a target graphite is sputtered in a nitrogen gas atmosphere, or an atmosphere of a mixture gas of nitrogen and argon.

Next, embodiments having a spacer which moves charges on the carbon nitride film to the substrate side, will be described with reference to the accompanying drawings.

FIFTH EMBODIMENT

In this embodiment, a plurality of surface conductivity type electron sources 14 still not subjected to the energization forming process were formed on the substrate 13. A cleaned blue plate glass was used as the substrate 13, and 160×720 surface conductivity type electron emitting elements shown in FIGS. 4A and 4B were disposed in a matrix shape. The element electrodes 27 and 28 are an Ni sputtered film. The X-direction and Y-direction wiring lines 15 and 16 are Ag wiring lines formed through screen printing. The conductive thin film 29 is a PdO fine particle film formed by baking Pd amine complex solution.

The fluorescent film 20 as an image forming member has fluorescent stripes of respective colors extending in the Y direction as shown in FIG. 5A. The black color material 20*a* is disposed not only between fluorescent stripes of respective colors, but also in the X direction to thereby separate pixels in the Y direction and reserve the areas for mounting the spacers 22. The black color material (conductive material) 20*a* was first formed, and then fluorescent materials of respective colors were coated in spaces formed by the black color material to form the fluorescent film 20. As the material of the black stripe (black color material 20*a*), material whose main component is black lead commonly used was used. Fluorescent material was coated on a face plate by a slurry method.

The metal back 21 to be mounted on the inner surface side of the fluorescent film 20 on the electron source side was formed by smoothing (normally called filming) the inner surface side of the fluorescent film 20 formed on the face plate 19, and thereafter by depositing Al through vacuum vapor deposition. In order to raise conductivity of the fluorescent film 20, the face plate 19 is provided in some cases with a transparent electrode on the outer surface side of the fluorescent film 20 (between glass substrate and fluorescent film). However, in this embodiment, it was omitted because only the metal back can provide sufficient conductivity.

Figure 20:
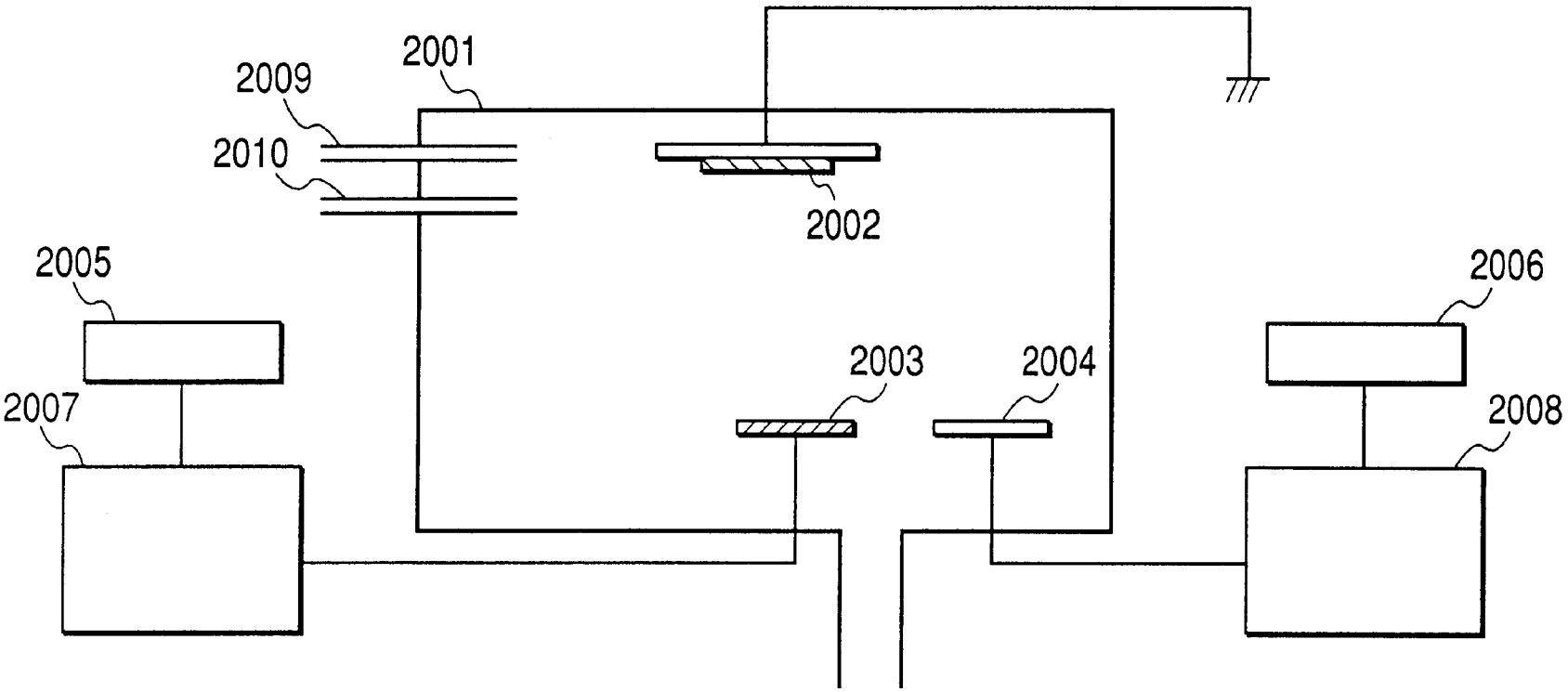
FIG. 20 is a schematic diagram showing the outline of a sputtering system used for a fifth embodiment.

Referring to FIG. 19, the spacer 22 was formed first by depositing a Cr—Al alloy nitride film 23*a* through vacuum vapor deposition on the cleaned insulating base material 24 (plate of 3.8 mm wide, 200 $\mu$m thick, 20 mm long) made of soda lime glass. The Cr—Al alloy nitride film used in the embodiment was formed by sputtering both Cr and Al targets at the same time in an argon and nitrogen mixture atmosphere by using a sputtering system. The sputtering system used is shown in FIG. 20. In FIG. 20, reference numeral 2001 represents a film forming chamber, reference numeral 2002 represents a spacer substrate, reference numerals 2003 and 2004 represent Cr and Al targets, reference numerals 2005 and 2006 represents high frequency power sources for applying high frequency voltages to the targets 2003 and 2004, reference numerals 2007 and 2008 represent matching boxes, and reference numerals 2009 and 2010 represent inlet pipes for introducing argon and nitrogen gasses.

Sputtering was performed by introducing argon gas and nitrogen gas into the film forming chamber 2001 at a partial pressure ratio of 7:3 and a total pressure of 0.45 Pa, and by applying high frequency voltages across the targets and spacer substrate to generate discharge. An optimum resistance value was obtained by controlling the compositions of Cr and Al by changing the high frequency powers supplied to the targets. Three kinds of Cr—Al alloy nitride films were formed.

After the first layer or Cr—Al alloy nitride film was formed, a second layer 23*b* was formed on the first layer 23*a*, by maintaining the vacuum of the film forming chamber used for the first layer. The second layer 23*b* was formed in the following manner. The second layer was formed after the first layer was formed, without taking the spacer substrate out of the chamber. The target was graphite, and the film forming rate was regulated by changing the supplied power. In this embodiment, nitrogen was introduced into the film forming chamber,, the pressure was maintained at 5 mTorr and the supplied power to the target was 3.8 W/cm$^2$. At the film forming time of 4 minutes, the carbon nitride film having a thickness of about 10 nm after the manufacture processes of the image forming apparatus, was obtained.

The intermediate electrodes 25 made of Al were placed at the abut surfaces of the spacer 22 in order to ensure a reliable electrical connection to the X-direction wiring line and metal back and maintain the potentials constant. The intermediate electrode 25 fully covered the four sides of the spacer 22 by 150 $\mu$m from the X-direction wiring line toward the face plate and by 100 $\mu$m from the metal back toward the rear plate.

Thereafter, the face plate 19 was mounted on the support frame 18 at the position 3.8 mm higher than the electron source 14, and the rear plate 13, face plate 19, support frame 18, and spacers 22 were adhered together at their junctions. The spacers were fixed at an equal pitch on the X-direction wiring lines 15. Electrical conduction between the carbon nitride film 23 of the spacer 22 and the face plate 19 on the black color material 20*a* (line width of 300 $\mu$m) was ensured by using the conductive frit glass 26 containing silica balls coated with Au. The metal back 21 was partially removed in the area where the metal back 21 and spacer 22 are coupled. The rear plate 17 and support frame 18 were adhered together at the junction by coating frit glass (not shown) and baking it at 420° C. for 10 minutes or longer in the atmospheric air. Spacer samples formed in the above manner will be described briefly hereinunder.

In a spacer sample A, the first layer is made of Cr—Al—N, having a thickness of 200 nm and a specific resistivity of $1.0\times10^4$ Ωm, and the second layer is made of carbon nitride having a thickness of 10 nm.

In a spacer sample B, the first layer is made of Cr—Al—N, having a thickness of 200 nm and a specific resistivity of $4.1\times10^3$ Ωm, and the second layer is made of carbon nitride having a thickness of 10 nm.

In a spacer sample C, the first layer is made of Cr—Al—N, having a thickness of 200 nm and a specific resistivity of $2.3\times10^3$ Ωm, and the second layer is made of carbon nitride having a thickness of 10 nm.

The display panel completed in the above manner was connected to the vacuum pump via the exhaust pipe to evacuate the inside thereof. After a sufficiently low pressure was obtained, a voltage was applied via the external terminals Dx1 to Dxm and Dy1 to Dyn across the element electrodes 27 and 28 to make the conductive films 29 be subjected to the energization forming process and to form the electron emitting portions 30. The energization forming process was performed by applying a voltage having the waveform shown in FIG. 7.

Next, acetone was introduced via the exhaust pipe into the vacuum chamber to reach a pressure of 0.013 Pa. By periodically applying a voltage pulse to the external terminals Dx1 to Dxm and Dy1 to Dyn, the energization activating process of depositing carbon or carbon compound was performed. The voltage having the waveform shown in FIG. 8A was applied for the energization activating process.

Next, while the vacuum chamber was heated to 200° C., the inside of the vacuum chamber was evacuated for 10 hours. At the inside pressure of about $10^{-4}$ Pa, the exhaust pipe was heated with a gas burner to melt it and hermetically seal the vacuum chamber.

Lastly, a getter process was performed in order to maintain the pressure after the sealing.

With the image forming apparatus completed in the above manner, a scan signal and a modulation signal generated from an unrepresented signal generator were applied via the external terminals Dx1 to Dxm and Dy1 to Dyn to each electron emitting element 14 to emit therefrom electrons, and a high voltage was applied via the high voltage terminal Hv to the metal back 21 to accelerate the emitted electron beam and make it collide with the fluorescent film 20, to thereby excite the fluorescent material 20*b* and generate light and display an image. The voltage Va applied to the high voltage terminal Hv was set to 3 to 7 kV, and a voltage Vf applied across the element electrodes 27 and 28 was set to 14 V Under the above drive conditions, a beam shift near the spacer sample A was 60 $\mu$m or smaller and that near the spacer samples B and C hardly appeared and posed no problem for a television image. The temperature coefficient of the Cr—Al—N first layer was −0.3 to −0.33% and no thermorunawaty was observed under the above drive conditions.

SIXTH EMBODIMENT

With Changed Thickness of Second Layers

In the sixth embodiment, the first layer was formed by the same method as the fifth embodiment, and the thickness of the second layer was made different from the first embodiment. With such spacers, television images are compared. The second film forming conditions were the same as the fifth embodiment. By changing the film forming time, the film thickness was controlled. Spacer samples of this embodiment are as follows.

In a spacer sample D, the first layer is made of Cr—Al—N, having a thickness of 200 nm and a specific resistivity of $4.1\times10^3$ Ωm, and the second layer is made of carbon nitride having a thickness of 5 nm.

In a spacer sample E, the first layer is made of Cr—Al—N, having a thickness of 200 nm and a specific resistivity of $4.1\times10^3$ Ωm, and the second layer is made of carbon ritride having a thickness of 20 nm.

In a spacer sample F, the first layer is made of Cr—Al—N, having a thickness of 200 nm and a specific resistivity of $4.1\times10^3$ Ωm, and the second layer is made of carbon nitride having a thickness of 60 nm.

The succeeding assembly processes were the same as the fifth embodiment, and the drive conditions were also the same as the fifth embodiment.

There was no or a very small beam shift near the spacer samples D and E under the above drive conditions, and the television images posed no problem. However, electrons emitted from an electron source nearest to the sample spacer F was attracted by about one fifth the scan line pitch under the above drive conditions, and the television image was associated with some problems.

SEVENTH EMBODIMENT

The first layer is made of Cr—SiO cermet. Spacer samples of this embodiment are as follows.

In a spacer sample G, the first layer is made of Cr—SiO cermet, having a thickness of 150 nm and a specific resistivity of $9.4\times10^3$ Ωm, and the second layer is made of carbon nitride having a thickness of 25 nm.

In a spacer sample H, the first layer is made of Cr—SiO cermet, having a thickness of 150 nm and a specific resistivity of $9.4\times10^3$ Ωm, and the second layer is made of carbon nitride having a thickness of 8 nm.

The first layer was formed by the method same as the fifth embodiment, excepting that SiO and Cr were used as the targets. Under the argon pressure during sputtering being maintained at 0.5 Pa, a power of 7.6 W/cm$^2$ was applied to the SiO target and a power of 0.13 W/cm$^2$ was applied to the Cr target, respectively for 40 minutes. The thickness of a Cr—SiO film formed was 150 nm. The second layer 23*b* was formed by the same method as the fifth embodiment.

The succeeding assembly processes were the same as the fifth embodiment, and the drive conditions were also the same as the fifth embodiment. There was only a very small beam shift near the spacer samples G and H under the above drive conditions, and the television images posed no problem. The temperature coefficient of the Cr—SiO cermet first layer was −0.3% and no thermorunaway was observed under the above drive conditions.

COMPARATIVE EXAMPLE 2

As a comparative example, on a substrate of soda lime glass same as the embodiments, a tin oxide film was formed under the conditions of a sputter gas pressure of 0.5 Pa and a supplied power of 2.8 W/cm$^2$. By using this substrate as the spacer, the image forming apparatus was manufactured by the method same as the embodiments. The specific resistivity of the tin oxide film was $9.2\times10^{-2}$ Ωm after the assembly processes and the acceleration voltage Va was unable to raise to 1 kV and an image was unable to be displayed at all.

Next, other embodiments will be described in which while a carbon nitride film is formed, a negative bias voltage is applied to the base material on which the carbon nitride film is formed.

If a negative bias voltage is applied to the insulating base material of a spacer on which a carbon nitride film is formed by sputtering, the carbon nitride film having a more excellent acid resistance can be formed as compared to the film without the negative bias voltage.

If a negative bias voltage is applied to the insulating base material of a spacer, nitrogen ions collide with the base material with a large energy so that reaction between nitrogen and carbon is enhanced. Therefore, structures (such as $C_3N_4$) having a higher bonding energy increase, to which an enhancement of heat resistance may be ascribed.

If a bias voltage is further raised, the base material is abraded more by the collisions of nitrogen ions with the base material. Structures having a weak bonding force cannot exist in the film so that a charge preventing film having more excellent characteristics can be formed.

However, if the bias voltage is raised too high, the film forming rate of carbon nitride becomes considerably slow which is not preferable from the viewpoint of manufacture yield. From this viewpoint, it is preferable to set the film forming rate to 5 angstroms/min or higher, or more preferably 10 angstroms/min or higher.

EIGHTH EMBODIMENT

In this embodiment, the spacer conductive film is a single layer structure of only a carbon nitride film such as shown in FIG. 1. The following description will be given with reference to FIG. 1.

A spacer insulating base material 24 made of cleaned soda lime glass (1.0 mm wide, 40 mm long, 0.2 mm thick) was prepared, and on this material 24, an $Si_3N_4$ film was formed as an Na blocking layer through RF sputtering under the following conditions.

$Si_3N_4$ film: a film forming gas pressure of 1 mTorr, Ar:$N_2$=7:3, an Si target supply power density of 6.3 W/cm$^2$, a film forming time of 50 min, and a film thickness of 200 nm.

Figure 21:
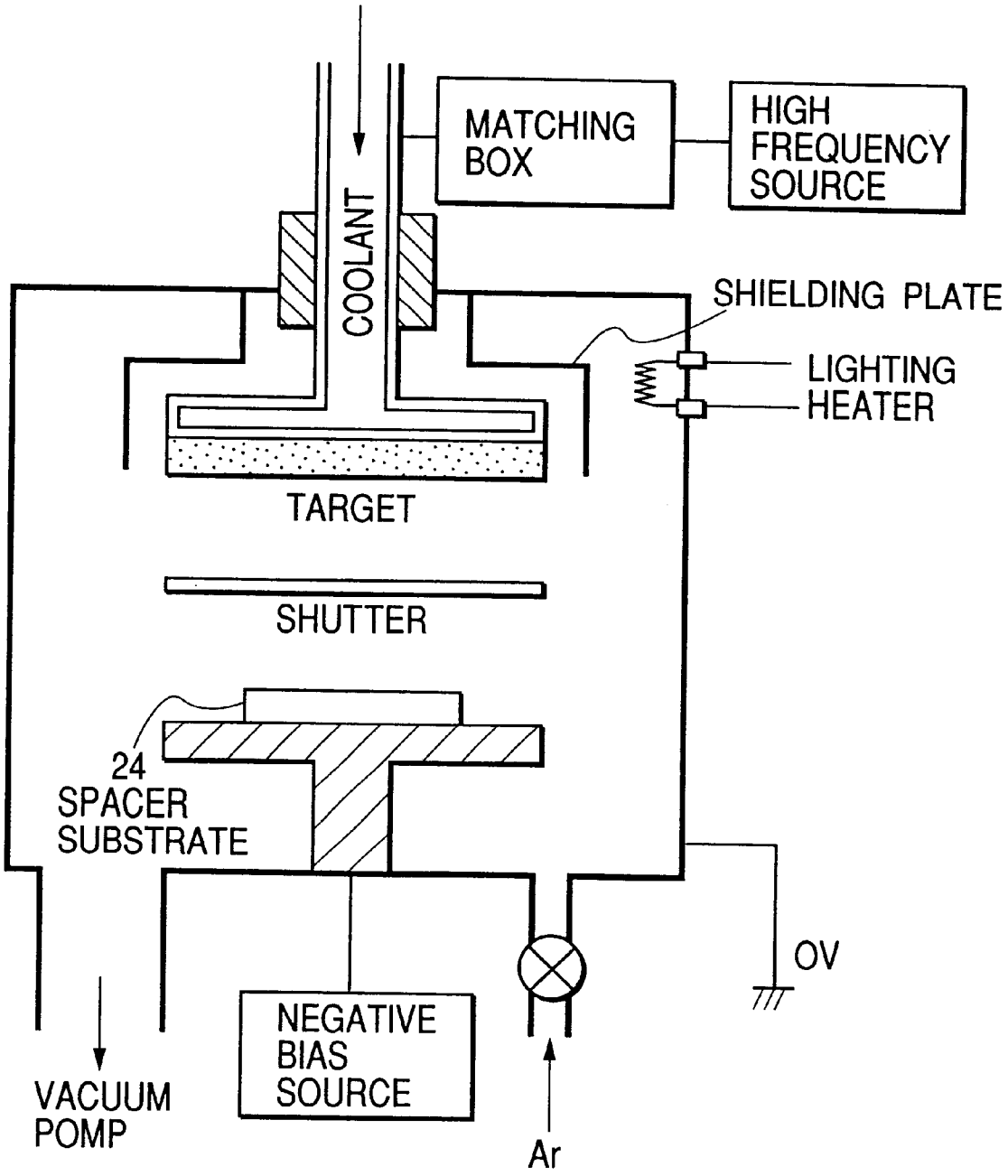
FIG. 21 is a diagram showing th e structure of a sputtering system used for embodiments.

In order to form a carbon nitride film of a single layer structure on the spacer base material coated with the $Si_3N_4$, the spacer base material was placed in a sputtering system and each of spacer samples A, B and C was formed under the following conditions. The sputtering system used is not limited only to a particular system, but any system may be used so long as it can form a film under the following conditions. FIG. 21 shows a sputtering system used for the following embodiments.

Spacer sample A: a film forming nitrogen pressure of 1 mTorr, a graphite target power density of 1.9 W/cm$^2$, a base material bias potential of −120 V, a film forming rate of 2 nm/min, and a film thickness of 100 nm after 50 minutes.

Spacer sample B: a film forming nitrogen pressure of 1 mTorr, a graphite target power density of 1.9 W/cm$^2$, a base material bias potential of −260 V, a film forming rate of 1 nm/min, and a film thickness of 100 nm after 100 minutes.

Spacer sample C: a film forming nitrogen pressure of 1 mTorr, a graphite target power density of 6.3 W/cm$^2$, a base material bias potential of −260 V, a film forming rate of 5 nm/min, and a film thickness of 100 nm after 20 minutes.

Thereafter, a display panel was assembled by using the above spacer samples. First, the intermediate electrodes 25 made of Al were placed at the abut surfaces of the spacer in order to ensure a reliable electrical connection to the X-direction wiring line and metal back and maintain the potentials constant. The intermediate electrode 25 fully covered the four sides of the spacer 22 by 50 μm from the X-direction wiring line toward the face plate and by 50 μm from the metal back toward the rear plate.

Thereafter, the face plate 19 was mounted on the support frame 18 ait the position 1.2 mm higher than the electron source 14, and the rear plate 13, face plate 19, support frame 18, and spacers 22 were adhered together at their junctions. Electrical conduction between the carbon nitride film 23 and the face plate 19 on the black color material 20*a* (line width of 300 μm) was ensured by using the conductive frit glass 26 containing silica balls coated with Au. The metal back 21 was partially removed in the area where the metal back 21 and spacer 22 are coupled. The rear plate 17 and support frame 18 were adhered together at the junction by coating frit glass (not shown) and baking it at 420° C. for 10 minutes or longer in the atmospheric air.

The display panel completed in the above manner was connected to the vacuum pump via the exhaust pipe to evacuate the inside thereof. After a sufficiently low pressure was obtained, a voltage was applied via the external terminals Dx1 to Dxm and Dy1 to Dyn across the element electrodes 27 and 28 to make the conductive films 29 be subjected to the energization forming process and to form the electron emitting portions 30. The energization forming process was performed by applying a voltage having the waveform shown in FIG. 7.

Next, acetone was introduced via the exhaust pipe into the vacuum chamber to reach a pressure of 0.013 Pa. By periodically applying a voltage pulse to the external terminals Dx1 to Dxm and Dy1 to Dyn, the energization activating process of depositing carbon or carbon compound was performed. The voltage having the waveform shown in FIG. 8A was applied for the energization activating process.

Next, while the vacuum chamber was heated to 200° C., the inside of the vacuum chamber was evacuated for 10 hours. At the inside pressure of about $10^{-4}$ Pa, the exhaust pipe was heated with a gas burner to melt it and hermetically seal the vacuum chamber.

Lastly, a getter process was performed in order to maintain the pressure after the sealing.

With the image forming apparatus completed in the above manner, a scan signal and a modulation signal generated from an unrepresented signal generator were applied via the external terminals Dx1 to Dxm and Dy1 to Dyn to each electron emitting element 14 to emit therefrom electrons, and a high voltage was applied via the high voltage terminal Hv to the metal back 21 to accelerate the emitted electron beam and make it collide with the fluorescent film 20, to thereby excite the fluorescent material 20*b* and generate light and display an image. The voltage Va applied to the high voltage terminal Hv was set to 3 to 7 kV, and a voltage Vf applied across the element electrodes 27 and 28 was set to 14 V.

In this embodiment, it was possible to apply an acceleration voltage Va up to 7 kV without any discharge, and an image of a good quality without any distortion caused by a beam shift was able to display.

The image forming apparatus completed in the above manner was disassembled and the thicknesses of the carbon nitride films on the spacer surfaces were measured. The spacer sample A had a thickness of about 50 nm, the spacer sample B had a thickness of about 30 nm, and the spacer sample C had a thickness of about 70 nm. Each of the spacer samples had a uniform thickness and had no locally thin film area or no area where there is no film.

COMPARATIVE EXAMPLE 3

As a comparcative example, a substrate of soda lime glass was used as the spacer without forming a cover of a carbon nitride film, and an image forming apparatus was manufactured by using such spacers by the processes similar to those of the above embodiments. The secondary emission rate of the glass is nearly 3.5. With this comparative example, creeping discharge occurred on the spacer surface at an acceleration voltage Va of 2.5 kV and a sufficient luminance was unable to obtain. Electrons from the electron emitting element nearest to the spacer were deflected toward the spacer by charges on the spacer, and a distortion of the image was confirmed at this position.

NINTH EMBODIMENT

In the ninth embodiment, the insulating base material 24 of the spacer was formed by the method same as the eighth embodiment, and an electron source type display panel was also assembled by the method same as the eighth embodiment. However, the glass substrate having a width of 2.8 mm was used. The spacer conductive film had a two-layer structure, and the following spacers were formed. The following description will be given with reference to FIG. 18.

Manufacture of Spacer

In this embodiment, the spacer conductive film of a two-layer structure was used, and a Cr—Al alloy nitride film 23*a* having a charge preventing function was formed under a carbon nitride film 23*b*.

[First layer: formation of a Cr—Al alloy nitride film]

As shown in FIG. 18, the Cr—Al alloy nitride film 23*a* of the spacer 22 was formed through vacuum vapor deposition on the insulating base material 24 (plate of 2.8 mm wide, 200 μm thick, 40 mm long) made of cleaned soda lime glass.

Sputtering was performed by introducing argon gas and nitrogen gas into the film forming chamber at a partial pressure ratio of 7:3 and a total pressure of 0.45 Pa, and by applying high frequency voltages across the targets and spacer substrate to generate discharge.

An optimum resistance value was obtained by controlling the compositions of Cr and Al by changing the high frequency powers supplied to the targets. In this embodiment, the film thickness was 2000 angstroms, and the resistance value of the spacer was $1.0\times10^{10}$ Ω and the specific resistivity thereof was $2.86\times10^{6}$ Ωcm.

[Second layer: formation of carbon nitride film]

After the first layer 23*a* was formed, the second layer 23*b* of carbon nitride was formed on the first layer 23*a*, by maintaining the vacuum of the film forming chamber used for the first layer. The film forming method is as follows.

Nitrogen gas was introduced into the film forming chamber, and the pressure was maintained at 1 mTorr. Sputtering was performed by applying high frequency voltages across a. graphite target and the spacer base material to generate discharge. The supplied power to the target was 1.9 W/cm$^2$. A bias voltage was applied to the spacer base material. The bias voltage of the spacer base material was maintained near at −120 V during the sputtering process. The deposition rate of the carbon nitride film 23*b* was about 20 angstroms/min. The carbon nitride film 23*b* having a thickness of 300 angstroms was formed after 15 minutes. This spacer is used as a spacer sample D.

A spacer sample E was formed under the following conditions. The supplied power to the target was 1.9 W/cm$^2$. The bias voltage of the spacer base material was maintained near at: −260 V during the sputtering process. The deposition rate of the carbon nitride film 23*b* was about 10 angstroms/min. The carbon nitride film 23*b* having a thickness of 300 angstroms was formed after 30 minutes.

A spacer sample F was formed under the following conditions. The supplied power to the graphite target was 6.3 W/cm$^2$. The bias voltage of the spacer base material was maintained near at −260 V during the sputtering process. The deposition rate of the carbon nitride film 23*b* was about 50 angstroms/min. The carbon nitride film 23*b* having a thickness of 300 angstroms was formed after 6 minutes.

The succeeding processes same as the eighth embodiment were performed to complete an image forming apparatus. In this case, a different point from the eighth embodiment is that a distance between the rear and face plates wias set to about 3 mm.

[Results]

With the image forming apparatus completed in the above manner, a scan signal and a modulation signal generated from an unrepresented signal generator were applied via the external terminals Dx1 to Dxm and Dy1 to Dyn to each electron emitting element 14 to emit therefrom electrons, and a high voltage was applied via the high voltage -terminal Hv to the metal back 21 to accelerate the emitted electron beam and make it collide with the fluorescent film 20, to thereby excite the fluorescent material 20*b* and generate light and display an image. The voltage Va applied to the high voltage terminal Hv was set to 3 to 7 kV, and a voltage Vf applied across the element electrodes 27 and 28 was set to 14 V.

A beam shift near the spacer samples D, E, and F was very small under the above drive conditions, and this beam shift posed no practical problem of a television image.

This display panel was thereafter disassembled and the thicknesses of the carbon nitride films on the spacer surfaces were measured. The spacer sample D had a thickness of about 15 nm, the spacer sample E had a thickness of about 8 nm, and the spacer sample F had a thickness of about 20 nm. Although the films were thinned as above, each of the spacer samples had a uniform thickness over the whole area of the display panel and had no locally thin film area or no area where there is no film. The films were suitable from the viewpoints of uniformity and manufacture yield.

COMPARATIVE EXAMPLE 4

As a comparative example, on a substrate of soda lime glass same as the above embodiment, a tin oxide film was formed by sputtering a tin oxide target with argon gas under the conditions of a sputter gas pressure of 0.5 Pa. and a supplied power of 2.8 W/cm$^2$. By using this substrate as the spacer, the image forming apparatus was manufactured by the method same as the above embodiment. The specific resistivity of the tin oxide film was $9.2\times10^{-2}$ Ωm after the assembly processes and the acceleration voltage Va was unable to raise to 1 kV and an image was unable to be displayed at all.

Next, other embodiments will be described in which carbon nitride is exposed to halogen containing gas.

If carbon nitride on the spacer surface is exposed to halogen containing gas, a stable spacer difficult to be oxidized during the panel assembly processes can be formed.

A carbon nitride film has graphite and $C_3N_4$ fine crystals mixed together. Nitryl groups (—C≡N) and hydroxyl groups (—OH) are present at dangling bonds or lattice defects of these fine crystals. These sites are highly active against attacks of oxygen and water, and determine the performances of oxidation during heat treatments and film peel-off to be caused by attacks of water in the atmospheric air.

In the following embodiments, carbon nitride is exposed to vapor (gas) which contains halogen such as $Cl_2$, $F_2$, and $Br_2$, and these molecules are terminated (not chemical bonding but physical adsorption) at active sites so that the resistance for oxidation and film peel-off can be improved.

In this case, if this exposure process is performed at a high temperature, these molecules can be terminated at those sites where adsorption is difficult. It is preferable to set this high temperature to a temperature higher than the highest temperature used in the assembly processes of an image forming apparatus. In order to enhance the effects of the exposure process, it is preferable to perform the exposure process at 600° C. or higher.

A stable spacer difficult to be oxidized during the panel assembly processes can be formed if carbon nitride is reacted with only halogen or compound of only halogen and carbon at a high temperature.

TENTH EMBODIMENT

In this embodiment, the spacer conductive film of a single layer structure of carbon nitride was used. The following description will be given with reference to FIG. 1.

As the spacer insulating base material 24, a ceramic complex primarily composed of alumina (1.0 mm wide, 40 mm long, 0.2 mm thick) was used. A composition ratio of alumina to the other components was adjusted so as to have the same thermal expansion coefficient of soda lime glass.

(Formation of carbon nitride film)

The carbon nitride film was formed in the following manner.

Nitrogen gas was introduced into the film forming chamber, and the pressure was maintained at 1 mTorr. Sputtering was performed by applying high frequency voltages across a target of graphite or the like and the spacer base material to generate discharge. The supplied power to the target was 1.9 W/cm$^2$. The carbon nitride film 23*b* having a thickness of 30 nm was formed.

(Halogen exposure process)

Thereafter, the spacer was subjected to the halogenizing process in the following manner.

A mixture gas of nitrogen and $CCl_2F_2$ was introduced into the film forming chamber at a partial pressure ratio 0.5% of $CCl_2F_2$ and at a total pressure same as the atmospheric pressure, thereafter the film forming chamber was hermetically sealed. A resistance heating unit was placed in advance in the chamber, and the spacer formed with the carbon nitride film was placed on the resistance heating unit. The spacer was being fixed to the heating unit so that the carbon nitride film surface becomes in contact with the introduced gas. Power was then supplied to the resistance heating unit to raise the temperature of the spacer at a rate of 10° C./min. This temperature rise was stopped at 600° C. and maintained at this temperature for one hour. Thereafter, the temperature was lowered at a rate of 5° C./min to the room temperature and then all gasses were exhausted to terminate the halogen exposure process.

[Assembly of spacers and panel]

Thereafter, a display panel was assembled by using the above spacers. First, the intermediate electrodes 25 made of Al were placed at the abut surfaces of the spacer in order to ensure a reliable electrical connection to the X-direction wiring line and metal back and maintain the potentials constant. The intermediate electrode 25 fully covered the four sides of the spacer 22 by 50 μm from the X-direction wiring line toward the face plate and by 50 μm from the metal back toward the rear plate.

Thereafter, the face plate 19 was mounted on the support frame 18 at the position 1.0 mm higher than the electron source 14, and the rear plate 13, face plate 19, support frame 18, and spacers 22 were adhered together at their junctions. Electrical conduction between the carbon nitride film 23 and the face plate 19 on the black color material 20*a* (line width of 300 μm) was ensured by using the conductive frit glass 26 containing silica balls coated with Au. The metal back 21 was partially removed in the area where the metal back 21 and spacer 22 are coupled. The rear plate 17 and support frame 18 were adhered together at the junction by coating frit glass (not shown) and baking it at 420° C. for 10 minutes or longer in the atmospheric air.

The display panel completed in the above manner was connected to the vacuum pump via the exhaust pipe to evacuate the inside thereof. After a sufficiently low pressure was obtained, a voltage was applied via the external terminals Dx1 to Dxm and Dy1 to Dyn across the element electrodes 27 and 28 to make the conductive films 29 be subjected to the energization forming process and to form the electron emitting portions 30. The energization forming process was performed by applying a voltage having the waveform shown in FIG. 7.

Next, acetone was introduced via the exhaust pipe into the vacuum chamber to reach a pressure of 0.013 Pa. By periodically applying a voltage pulse to the external terminals Dx1 to Dxm and Dy1 to Dyn, the energization activating process of depositing carbon or carbon compound was performed. The voltage having the waveform shown in FIG. 8A was applied for the energization activating process.

Next, while the vacuum chamber was heated to 200° C., the inside of the vacuum chamber was evacuated for 10 hours. At the inside pressure of about $10^{-4}$ Pa, the exhaust pipe was heated with a gas burner to melt it and hermetically seal the vacuum chamber.

Lastly, a getter process was performed in order to maintain the pressure after the sealing.

[Results]

With the image forming apparatus completed in the above manner, a scan signal and a modulation signal generated from ar unrepresented signal generator were applied via the external terminals Dx1 to Dxm and Dy1 to Dyn to each electron emitting element 14 to emit therefrom electrons, and a high voltage was applied via the high voltage terminal Hv to the metal back 21 to accelerate the emitted electron beam and make it collide with the fluorescent film 20, to thereby excite the fluorescent material 20*b* and generate light and display an image. The voltage Va applied to the high voltage terminal Hv was set to 3 to 7 kV, and a voltage Vf applied across the element electrodes 27 and 28 was set to 14 V.

An image formed by the image forming apparatus with the above spacers had hardly an image distortion to be caused by charges on the spacer, without posing any practical problem of a television image.

The image forming apparatus completed in the above manner was disassembled and the thicknesses of the carbon nitride films on the spacer surfaces were measured. Although the film thickness was reduced to about 15 nm, it was uniform.

COMPARATIVE EXAMPLE 5

As a comparative example, a substrate made of only soda lime glass was used as the scalper without forming a cover of a carbon nitride film, and an image forming apparatus was manufactured by the processes similar to those of the above embodiments. The secondary emission rate of the glass, is nearly 3.5. With this comparative example, creeping discharge occurred on the spacer surface at an acceleration voltage Va of 2.5 kV and a sufficient luminance was unable to obtain. Electrons from the electron emitting element nearest to the spacer were deflected toward the spacer by charges on the spacer, and a distortion of the image was confirmed at this position.

ELEVENTH EMBODIMENT

In the eleventh embodiment, the insulating base material 24 of the spacer was formed by the method same as the tenth embodiment, and an electron source type display panel was also assembled by the method same as the tenth embodiment. However, the glass substrate having a width of 2.8 mm was used. The spacer conductive film had a two-layer structure, and the following spacers were formed. The following description will be given with reference to FIG. 18.

Manufacture of Spacer

In this embodiment, the spacer conductive film of a two-layer structure was used, and a Cr—Al alloy nitride film 23*a* having a charge preventing function was formed under a carbon nitride film 23*b*.

[First layer: formation of Cr—Al alloy nitride film]

As shown in FIG. 18, a ceramic complex primarily composed of alumina of the spacer 22 was formed through vacuum vapor deposition on the insulating base material 24 (plate of 2.8 mm wide, 200 μm thick, 40 mm long) of insulating ceramics adjusted to have the same thermal expansion coefficient as soda lime glass.

Sputtering was performed by introducing argon gas and nitrogen gas into the film forming chamber at a partial pressure ratio of 7:3 and a total pressure of 0.45 Pa, and by applying high frequency voltages across the targets and spacer substrate to generate discharge. An optimum resistance value was obtained by controlling the compositions of argon and nitrogen by changing the high frequency powers supplied to the targets. In this embodiment, the film thickness was 2000 angstroms, and the resistance value of the spacer was $1.0\times10^{10}$ Ω and the specific resistivity thereof was $2.86\times10^{6}$ Ωcm.

[Second layer: formation of carbon nitride film]

After the first layer 23*a* was formed, the second layer 23*b* of carbon nitride was formed on the first layer 23*a*, by maintaining the vacuum of the film forming chamber used for the first layer. The film forming conditions are the same as the tenth embodiment. Specifically, nitrogen gas was introduced into the film forming chamber, and the pressure was maintained at 1 mTorr. Sputtering was performed by applying high frequency voltages across a target and the spacer base material to generate discharge. The supplied power to the target was 1.9 W/cm$^2$. The carbon nitride film 23*b* having a thickness of 30 nm was formed.

(Halogen exposure process)

Thereafter, the spacer was subjected to the halogenizing process in the following manner.

A mixture gas of $N_2$ and $Cl_2$ was introduced into the film forming chamber at a partial pressure ratio 1.0% of $Cl_2$ and at a total pressure same as the atmospheric pressure, thereafter the film forming chamber was hermetically sealed. A resistance heating unit was placed in advance in the chamber, and the spacer formed with the carbon nitride film was placed on the resistance heating unit. The spacer was being fixed to the heating unit so that the carbon nitride film surface becomes in contact with the introduced gas. Power was then supplied to the resistance heating unit to raise the temperature of the spacer at a rate of 10° C./min. This temperature rise was stopped at 600° C. and maintained at this temperature for one hour. Thereafter, the temperature was lowered at a rate of 5° C./min to the room temperature and then all gasses were exhausted to terminate the halogen exposure process.

[Assembly of spacers and panel]

The intermediate electrodes 25 made of Al were placed at the abut surfaces of the spacer in order to ensure a reliable electrical connection to the X-direction wiring Line and metal back and maintain the potentials constant. The intermediate electrode 25 fully covered the four sides of the spacer 22 by 50 $\mu$m from the X-direction wiring line toward the face plate and by 100 $\mu$m from the metal back toward the rear plate.

Thereafter, the face plate 19 was mounted on the support frame 18 at the position 1.0 mm higher than the electron source 14, and the rear plate 13, face plate 19, support frame 18, and spacers 22 were adhered together at their junctions. The spacers were fixed to the X-direction wiring lines 15 at an equal pitch.

[Results]

An image was displayed by using the image forming apparatus assembled in the above manner. In this embodiment, the acceleration voltage Va was able to raise to 5 kV without any discharge, and a luminance sufficient in practical use for an image forming apparatus was obtained. A good image was able to display with a small beam shift caused by charges on the spacer.

The image forming apparatus completed in the above manner was disassembled and the surface of the carbon nitride films were analyzed. Although the thickness of the carbon nitride film on the spacer surface was reduced to about 15 nm, all the spacers had uniform carbon nitride.

COMPARATIVE EXAMPLE 6

As a comparative example, on a substrate of soda lime glass same as the above embodiment, a tin oxide film was formed by sputtering a tin oxide target with argon gas under the conditions of a sputter gas pressure of 0.5 Pa and a supplied power of 2.8 W/cm$^2$. By using this substrate as the spacer, the image forming apparatus was manufactured by the method same as the above embodiment. The specific resistivity of the tin oxide film was $9.2\times10^{-2}$ Ωm after the assembly processes and the acceleration voltage Va was unable to raise to 1 kV and an image was unable to be displayed at all.

Although the present invention has been described with reference to the preferred embodiments, the invention is not limited only to the embodiments. For example, this invention is applicable to apparatuses having the structure that a component is disposed near an electron emitting portion.

In the above embodiments, the surface of the intermediate electrode is exposed. Instead, a carbon nitride film or other films may be formed on the surface of the intermediate electrode. If a conductive film is formed on the intermediate electrode and all or part of the exposed surface is covered with it, discharge from the intermediate electrode can be reduced. In this case, even if the end surface of the intermediate electrode on the substrate side is covered with the film, the effects of the intermediate electrode can be sufficiently retained if the film is not too thick.

As described so far, according to the invention, influence of charges on a component, typically the spacer, can be alleviated or the influence can be stabilized. A possibility of creeping discharge can be suppressed. A variation of a resistance value to be caused by an atmosphere gas can be lowered so that productivity can be improved.

The invention is particularly effective for an image forming apparatus in which electrons are accelerated at a voltage of 3 kV or higher to emit light from a fluorescent film.

By applying the present invention to an image forming apparatus, particularly its spacers, an image of a high quality with less distortion caused by a beam shift near the spacer can be obtained.

If carbon nitride is formed by applying a negative bias, a stable component can be obtained whose performance is hard to be changed and which is hard to be oxidized during a panel assembly process.

If carbon nitride is exposed to gas which containing halogen, a stable component can be obtained whose performance is hard to be changed and which is hard to be oxidized during a panel assembly process.

What is claimed is:

1. An electron beam apparatus comprising:

a first substrate having an electron emitting portion;

a second substrate facing said first substrate; and a first component provided between corresponding portions of said first and second substrates, wherein carbon nitride is formed on a surface of said first component, and the electron emitting portion emits at least one electron into a space provided between other corresponding portions of said first and second substrates.

2. An electron beam apparatus according to claim 1, wherein said first component is a spacer for maintaining a distance between said first and second substrates.

3. An electron beam apparatus according to claim 1, wherein the carbon nitride is formed on said first component in the form of a film.

4. An electron beam apparatus according to claim 1, wherein the carbon nitride is electrically insulative.

5. An electron beam apparatus, comprising:

a first substrate having an electron emitting portion;

a second substrate facing said first substrate; and a first component provided between said first and second substrates, wherein carbon nitride is formed on a surface of said first component, and wherein the carbon nitride is electrically conductive.

6. An electron beam apparatus according to claim 5, wherein the carbon nitride contains metal elements for adjusting a specific resistivity of the carbon nitride.

7. An electron beam apparatus according to claim 1, wherein the carbon nitride is formed on a conductive base material.

8. An. electron beam apparatus according to claim 1, wherein said first component is connected to electrodes having different potentials.

9. An electron beam apparatus according to claim 1, wherein said first substrate includes a plurality of electron emitting portions.

10. An electron beam apparatus according to claim 1, wherein the electron emitting portion is an electron emitting portion of a surface conductivity type electron emitting element formed on said first substrate.

11. An image forming apparatus comprising:

a first substrate having an electron emitting portion;

a second substrate facing said first substrate and having an image forming component for forming an image in accordance with electrons emitted from the electron emitting portion; and a first component provided between corresponding portions of said first and second substrates, wherein carbon nitride is formed on a surface of said first component, and the electron emitting portion emits at least one electron into a space provided between other corresponding portions of said first and second substrates.

12. An image forming apparatus, comprising:

a first substrate having an electron emitting portion;

a second substrate facing said first substrate and having an image forming component for forming an image in accordance with electrons emitted from the electron emitting portion; and a first component provided between said first and second substrates, wherein carbon nitride is formed on a surface of said first component, and wherein the image forming component is a fluorescent film.

13. A component for an electron beam apparatus, wherein the electron beam apparatus comprises:

a first substrate having an electron emitting portion;

a second substrate facing said first substrate; and a first component provided between corresponding portions of said first and second substrates, as the component for the electron beam apparatus, wherein carbon nitride is formed on a surface of said first component, and the electron emitting portion emits at least one electron into a space provided between other corresponding portions of said first and second substrates.

14. A method of manufacturing an electron beam apparatus, an image forming apparatus, or a component for the electron beam apparatus according to any one of claims 1 to 13, wherein the carbon nitride on said first component is formed by sputtering.

15. A method of manufacturing an electron beam apparatus having a first substrate having an electron emitting portion, a second substrate facing the first substrate, and a first component provided between the first and second substrates, the method comprising the step of:

forming carbon nitride on a surface of the first component by a sputtering process, the sputtering process being executed while a negative bias voltage is applied to a base material of the first component.

16. A method of manufacturing an electron beam apparatus according to claim 15, wherein the carbon nitride on a surface of the first component is formed by sputtering a carbon target in a nitrogen atmosphere.

17. A method of manufacturing an electron beam apparatus according to claim 16, wherein the carbon target is graphite.

18. A method of manufacturing an electron beam apparatus according to claim 15, wherein the first component is a spacer for maintaining a distance between the first and second substrates.

19. A method of manufacturing an electron beam apparatus having a first substrate having an electron emitting portion, a second substrate facing the first substrate, and a first component provided between the first and second substrates, the method comprising the step of:

exposing carbon nitride formed on a surface of the first component to a gas containing at least halogen or halogen compound.

20. A method of manufacturing an electron beam apparatus according to claim 19, wherein said exposing step is executed at a temperature higher than a highest temperature used until the electron beam apparatus is completed.

21. A method of manufacturing an electron beam apparatus according to claim 19 or 20, wherein said exposing step is executed at a temperature higher than a temperature at which the first and second substrates are adhered and sealed.

22. A method of manufacturing an electron beam apparatus according to claim 19, wherein the carbon nitride on a surface of the first component is formed by sputtering a carbon target in a nitrogen atmosphere.

23. A method of manufacturing an electron beam apparatus according to claim 22, wherein the carbon target is graphite.

24. A method of manufacturing an electron beam apparatus according to claim 19, wherein the first component is a spacer for maintaining a distance between the first and second substrates.

25. A method of manufacturing an image forming apparatus having a first substrate having an electron emitting portion, a second substrate facing the first substrate and having an image forming component for forming an image in accordance with electrons emitted from the electron emitting portion, and a first component provided between the first and second substrates, the method comprising the step of:

forming carbon nitride on a surface of the first component by a sputtering process, the sputtering process being executed while a negative bias voltage is applied to a base material of the first component.

26. A method of manufacturing an image forming apparatus having a first substrate having an electron emitting portion, a second substrate facing the first substrate and having an image forming component for forming an image in accordance with electrons emitted from the electron emitting portion, and a first component provided between the first and second substrates, the method comprising the step of:

exposing carbon nitride formed on a surface of the first component to a gas containing at least halogen or halogen compound.

27. A method of manufacturing a component for an electron beam apparatus having a first substrate having an electron emitting portion, a second substrate facing the first substrate, and a first component provided between the first and second substrates as the component for the electron beam apparatus, the method comprising the step of:

forming carbon nitride on a surface of the first component by a sputtering process, the sputtering process being executed while a negative bias voltage is applied to a base material of the first component.

28. A method of manufacturing a component for an electron beam apparatus having a first substrate having an electron emitting portion, a second substrate facing the first substrate, and a first component provided between the first and second substrates as the component for the electron beam apparatus, the method comprising the step of:

exposing carbon nitride formed on a surface of the first component to a gas containing at least halogen or halogen compound.

* * * * *

UNITED STATES PATENT AND TRADEMARK OFFICE

CERTIFICATE OF CORRECTION

PATENT NO. : 6,265,822 B1
DATED : July 24, 2001
INVENTOR(S) : Kazuo Kuroda et al.

It is certified that error appears in the above-identified patent and that said Letters Patent is hereby corrected as shown below:

Sheet 15,
FIG. 21, "POMP" should read -- PUMP --.

Column 1,
Line 29, "aL" should read -- al. --;
Line 57, "electron s" should read -- electrons --;
Line 61, "o r" should read -- or --;
Line 62, "molybdenum" should read -- Molybdenum --; and
Line 67, "cross sectional" should read -- cross-sectional --.

Column 2,
Line 15, "cross sectional"should read -- cross-sectional --.

Column 3,
Line 25, "become" should read -- becomes --; and
Line 66, "comprises" should read -- comprising --.

Column 4,
Line 14, "substrate;" should read -- substrate --;
Line 34, "at" should be deleted;
Line 54, "an d" should read -- and --;
Line 55, "sub stance" should read -- substance --;
Line 56, "an other" should read -- another --; and
Line 67, "be removed" should read -- remove --.

Column 5,
Line 1, "therefrom ," should read -- therefrom, --.

Column 6,
Lines 33, 48, 57 and 59, "cross sectional" should read -- cross-sectional --.

Column 7,
Lines 9,13 and 48, "cross sectional" should read -- cross-sectional --;
Line 17, "th e" should read -- the --;
Line 24, "of the" should be deleted;
Line 34, "provide" should read -- to provide --.

Column 8,
Line 31, "$Sp^{3"}$ should read -- $sp^3$ --.

UNITED STATES PATENT AND TRADEMARK OFFICE

CERTIFICATE OF CORRECTION

PATENT NO. : 6,265,822 B1
DATED : July 24, 2001
INVENTOR(S) : Kazuo Kuroda et al.

It is certified that error appears in the above-identified patent and that said Letters Patent is hereby corrected as shown below:

Column 9,
Line 23, "at," should read -- at --;
Line 36, "remove" should read -- removed --; and
Line 60, "form" should read -- for --.

Column 10,
Line 19, "possible" should read -- possibly --;
Line 20, "$_{\Delta}$" should read -- $_{\Delta}$cm --;
Line 22, "$_{\Delta}$" should read -- $_{\Delta}$cm --; and
Line 53, "is" should read -- be --.

Column 11,
Line 5, "nitride" should read -- nitrides --; and
Line 48, "raulti-electron-beam" should read -- multi-electron-beam --.

Column 12,
Line 29, "from" should read -- form --; and
Line 46, "used" should read -- be used --.

Column 13,
Line 35, "Uniforming" should read -- Making uniform --.

Column 15,
Line 47, "cross sectional" should read -- cross-sectional --.

Column 16,
Line 20, "overlapped" should read -- overlapping --; and
Line 46, "film 29s are" should read -- films 29 be --.

Column 17,
Line 22, "cross sectional" should read -- cross-sectional --.

Column 18,
Line 8, "embodiments," should read -- embodiment, --; and
Line 19, "VpE" should read -- Vpf -- and "Pea" should read -- per --.

UNITED STATES PATENT AND TRADEMARK OFFICE

CERTIFICATE OF CORRECTION

PATENT NO. : 6,265,822 B1
DATED : July 24, 2001
INVENTOR(S) : Kazuo Kuroda et al.

It is certified that error appears in the above-identified patent and that said Letters Patent is hereby corrected as shown below:

Column 19,
Line 4, "currently" should read -- current Ie --;
Line 11, "currently" should read -- current --;
Lines 15 and 19, "le" should read -- Ie --;
Lines 37 and 64, "cross sectional" should read -- cross-sectional --.

Column 21,
Line 7, "elements," should read -- elements. --;
Line 39, "black lead commonly" should read -- commonly black lead --; and
Line 40, "used" (first occurrence) should be deleted.

Column 22,
Line 2, "about" should read -- abutting --;
Line 5, "X-direct,ion" should read -- X-direction --; and
Line 67, "display." should read -- be displayed. --.

Column 23,
Lines 16 and 36, "$Sp^2$" should read -- $sp^2$ --;
Lines 18, 27 and 34, "$Sp^3$" should read -- $sp^3$ --;
Line 28, "$Sp^3$" (both occurrences) should read -- $sp^3$ --.

Column 25,
Line 17, "display." should read -- be displayed. --.

Column 26,
Line 12, "remove" should read -- removing --;
Line 20, "of" (first occurrence) should be deleted.

Column 27,
Line 8, "is" should read -- be --;
Line 11, "$(2X10^{-}$" should read -- 2X --;
Line 12, "$7)xVa^2$" should read -- $10^{-7}xVa^2$ --;
Line 27, "$In_2O_3$—$Al_2O_3$," should read -- $In_2O_3$—$Al_2O_3$, --;
Line 32, "first;" should read -- first --;
Lines 35 and 36, "is" should read -- be --.

Column 29,
Line 1, "represents" should read -- represent --;
Line 43, "chamber,," should read -- chamber, --.

UNITED STATES PATENT AND TRADEMARK OFFICE

CERTIFICATE OF CORRECTION

PATENT NO. : 6,265,822 B1
DATED : July 24, 2001
INVENTOR(S) : Kazuo Kuroda et al.

It is certified that error appears in the above-identified patent and that said Letters Patent is hereby corrected as shown below:

Column 30,
Line 55, "14V Under" should read -- 14V. ¶ Under --; and
Line 60, "thermorunawaty" should read -- thermolrunaway --.

Column 31,
Line 13, "ritride" should read -- nitride --;
Line 27, "was" should read -- were --;
Line 43, "excepting" should read -- except --.

Column 33,
Line 61, "display." should read -- be displayed --.

Column 34,
Line 14, "to obtain." should read -- to be obtained. --;
Line 59, "ao" should read -- a --; and
Line 63, "at" should be deleted.

Column 35,
Line 4, "at:" should be deleted;
Line 11, "at" should be deleted;
Line 18, "wias" should read -- was --;
Line 26, "voltage-terminal" should read -- voltage terminal --; and
Line 58, "raise" should read -- be raised --.

Column 36,
Line 57, "becomes" should read -- comes --.

Column 37,
Line 48, "ar" should read -- an --.

Column 38,
Line 3, "scalper" should read -- spacer --; and
Line 10, "obtain." should read -- be obtained. --.

UNITED STATES PATENT AND TRADEMARK OFFICE

CERTIFICATE OF CORRECTION

PATENT NO. : 6,265,822 B1
DATED : July 24, 2001
INVENTOR(S) : Kazuo Kuroda et al.

It is certified that error appears in the above-identified patent and that said Letters Patent is hereby corrected as shown below:

Column 39,
Line 6, "becomes" should read -- comes --;
Line 17, "Line" should read -- line --;
Line 35, "display" should read -- be displayed --; and
Line 52, "raise" should read -- be raised --.

Column 40,
Line 58, "An." should read -- An --.

Signed and Sealed this

Twenty-sixth Day of February, 2002

*Attest:*

*Attesting Officer*

JAMES E. ROGAN
*Director of the United States Patent and Trademark Office*